US009611597B2

(12) United States Patent
Grumberg et al.

(10) Patent No.: US 9,611,597 B2
(45) Date of Patent: Apr. 4, 2017

(54) ACCESS STRUCTURE INTEGRATION ASSEMBLY AND INTEGRATED ACCESS SYSTEMS AND METHODS OF USING THE SAME

(71) Applicant: Safway Services, LLC, Waukesha, WI (US)

(72) Inventors: Mathieu Grumberg, Delmar, NY (US); Roy Scrafford, Scotia, NY (US); Frederick W. Meade, North Creek, NY (US)

(73) Assignee: Safway Services, LLC, Waukesha, WI (US)

( * ) Notice: Subject to any disclaimer, the term of this patent is extended or adjusted under 35 U.S.C. 154(b) by 286 days.

(21) Appl. No.: 13/962,624

(22) Filed: Aug. 8, 2013

(65) Prior Publication Data

US 2015/0041252 A1 Feb. 12, 2015

(51) Int. Cl.

| | |
|---|---|
| ***E04G 7/02*** | (2006.01) |
| ***E01D 19/10*** | (2006.01) |
| ***E04C 3/09*** | (2006.01) |
| ***E04G 1/34*** | (2006.01) |
| ***E04G 3/22*** | (2006.01) |
| ***E04G 5/16*** | (2006.01) |
| ***E04G 21/30*** | (2006.01) |
| *E04G 21/24* | (2006.01) |

(52) U.S. Cl.

CPC ..... *E01D 19/106* (2013.01); *E04C 3/09* (2013.01); *E04G 1/34* (2013.01); *E04G 3/22* (2013.01); *E04G 5/16* (2013.01); *E04G 5/165* (2013.01); *E04G 7/02* (2013.01); *E04G 21/30* (2013.01); *E04G 2021/248* (2013.01)

(58) Field of Classification Search

CPC E01D 19/106; E04G 3/22; E04G 3/30; E04G 5/06; E04G 3/00; E04C 3/09

USPC ..... 182/150

See application file for complete search history.

(56) References Cited

U.S. PATENT DOCUMENTS 1,929,325 A * 10/1933 Masterson ..... 248/323
2,303,428 A * 12/1942 Black ..... 52/645

(Continued)

FOREIGN PATENT DOCUMENTS

JP H0925720 A 1/1997

OTHER PUBLICATIONS

International Search Report and Written Opinion for PCT/US2013/054170 dated May 14, 2014, 15 pages.

*Primary Examiner* — Charles A Fox
*Assistant Examiner* — Kristine Florio
(74) *Attorney, Agent, or Firm* — Husch Blackwell LLP

(57) ABSTRACT

The invention includes an access structure integration assembly and an integrated system using the assembly. An access structure integrated assembly includes at least one channeled structure and at least one joist socket slidingly engaged with the channeled structure. The channeled structure is configured to secure to a base structure, such as a suspended work platform system, and the joist socket is configured to secure to a second structure, such as a supported work platform system. An integrated system includes a base structure, a second structure and at least two integration assemblies, each assembly including a channeled structure secured to the base structure and a joist socket secured to the second structure and slidingly engaged with the channeled structure.

12 Claims, 25 Drawing Sheets

(56) References Cited

U.S. PATENT DOCUMENTS

| | | | | |
|---|---|---|---|---|
| 2,987,148 | A * | 6/1961 | Millard | 52/111 |
| 3,425,179 | A * | 2/1969 | Haroldson | 52/283 |
| 3,735,951 | A * | 5/1973 | Reed | 248/340 |
| 3,945,462 | A * | 3/1976 | Griswold | 182/150 |
| 4,070,847 | A * | 1/1978 | Madl, Jr. | 52/650.3 |
| 4,615,063 | A * | 10/1986 | Rolen | 14/18 |
| 5,214,899 | A * | 6/1993 | Beeche et al. | 52/648.1 |
| 6,158,186 | A * | 12/2000 | Feller | 52/506.06 |
| 7,096,633 | B1 * | 8/2006 | Bowen | 52/506.06 |
| 7,886,496 | B1 | 2/2011 | Spransy | |
| 2002/0069606 | A1 * | 6/2002 | Gosselin et al. | 52/690 |
| 2004/0020138 | A1 * | 2/2004 | Grearson | 52/64 |
| 2005/0217936 | A1 * | 10/2005 | Jolicoeur et al. | 182/130 |
| 2006/0016638 | A1 * | 1/2006 | Gluchowski | 182/150 |
| 2010/0171085 | A1 * | 7/2010 | Webster, IV | 256/65.14 |
| 2013/0036678 | A1 | 2/2013 | Nyce et al. | |
| 2013/0047541 | A1 * | 2/2013 | Mayer | 52/506.05 |

* cited by examiner

ACCESS STRUCTURE INTEGRATION ASSEMBLY AND INTEGRATED ACCESS SYSTEMS AND METHODS OF USING THE SAME

CROSS-REFERENCE TO RELATED APPLICATION

None.

STATEMENT REGARDING FEDERALLY SPONSORED RESEARCH OR DEVELOPMENT

None.

FIELD OF THE INVENTION

The invention relates, generally, to the field of construction and temporary structures that are erected to access various parts of various structures. In one aspect, the invention relates to the integration of supported work platform systems and suspended work platform systems and a structural assembly for accomplishing the same.

BACKGROUND OF THE INVENTION

Work platforms and other access structures, including suspended work platform systems and scaffolding, allow workers to access difficult to reach worksites and can be assembled on the job site as needed. For example, when working on structures such as bridges where there is no stable or suitable bottom surface for building up standard supported work platforms, suspended work platforms allow workers to access the undersides of these structures. Suspended work platforms also eliminate the need to build standard work platforms and platform systems to significant and unwieldy heights. However, suspended work platforms are not always ideal for accessing some structures. Supported work platforms may be beneficial to provide improved access to some structures, even after suspended work platforms are in place. It may therefore be beneficial to install supported work platforms on top of suspended work platforms.

Suspended work platforms use plywood panels secured in a frame-like structure to create a platform which is suspended from an overhead structure. The legs used with traditional supported work platforms impart large concentrated loads. The plywood panels used in suspended work platform systems are not able to withstand the pressures exerted by frame legs, and the loads must be properly distributed on structural members using dunnage and/or beams. Installing dunnage systems or beams requires significant equipment, effort and time. Further, dunnage systems only resist downward loads, and additional guy wires or bracing is necessary to resist sideways, upward or overturning forces. In other words, dunnage systems only prevent movement in a single direction, and a significant amount of extra equipment and material is needed to prevent standard work platform systems from moving or shifting when installed on a suspended work platform system. Dunnage cannot truly structurally integrate a standard supported work platform system with a suspended work platform system.

In summary, a need exists to overcome the above stated, and other, deficiencies in the art of work platform and work platform support systems. A need exists for an improved system to truly integrate suspended and supported work platforms and which properly distributes the forces exerted by supported work platform systems on structural members of suspended work platform systems.

SUMMARY OF THE INVENTION

To overcome the aforementioned, and other, deficiencies, the present invention provides a device for use with work platform system, a work platform support system, a work platform system, and a method of manufacturing and installing same.

In a first general aspect, the present invention provides an access structure integration assembly comprising at least one channeled structure, which may be a C channel, and at least one joist socket, wherein the joist socket is slidingly engaged with the channeled structure. In some embodiments, the channeled structure is a C channel comprising a solid, flattened bottom portion; two flattened side wall portions extending upward from the bottom portion at approximately right angles, each side wall portion terminating in a flange extending at a right angle from the side wall portions such that the flanges extend toward each other; and a linear gap extending the length of the C channel and having a width. In further embodiments, the joist socket is slidingly engaged with the channeled structure using at least one T-bolt which is slidingly engaged with the linear gap of the C channel. The T-bolt comprises a head having a width greater than that of the linear gap. In further embodiments, the joist socket comprises a hollow tubular body; and a base. In one embodiment of an integration assembly, the C channel is configured to secure to a base structure and the joist socket is configured to secure to a second structure. The base structure may be a suspended work platform system which is articulatable, and the second structure may be a supported work platform system. An access structure integration assembly according to the embodiments described herein may include a deck retainer.

According to a second general aspect, the present invention provides an access structure integration assembly comprising: at least one substantially squared channeled structure, the channeled structure comprising a solid, flattened bottom portion containing a plurality of apertures corresponding to the apertures of the deck retainer, two flattened side wall portions extending upward from the bottom portion at approximately right angles, each side wall portion terminating in a flange extending at a right angle from the side wall portions such that the flanges extend toward each other, and a linear gap extending the length of the channeled structure and having a width; at least one joist socket comprising a hollow tubular body and a base having a plurality of apertures; a plurality of T-bolts extending through the apertures of the joist socket and into the linear gap of the channeled structure and having a head portion with a width greater than that of the linear gap, wherein the T-bolts are slidingly engaged with the channeled structure and each of the T-bolts is secured with a nut; and optionally, at least one substantially linear deck retainer comprising a plurality of apertures corresponding to the apertures of the channeled structure, wherein the deck retainer is parallel to the channeled structure and secured to the channeled structure by a plurality of bolts, each bolt extending through a set of corresponding apertures of the channeled structure and deck retainer.

According to a third general aspect, the present invention provides a base structure comprising: at least one unit; at least two access structure integration assemblies secured to the at least one unit, each integration assembly comprising at least one channeled structure and at least one joist socket slidingly engaged with the channeled structure, wherein each channeled structure is secured to the unit.

In one embodiment, the channeled structure is a C channel which is a substantially squared tubular structure comprising a solid, flattened bottom portion; two flattened side wall portions extending upward from the bottom portion at approximately right angles, each side wall portion terminating in a flange extending at a right angle from the side wall portions such that the flanges extend toward each other; and a linear gap extending the length of the C channel and having a width. The joist sockets are slidingly engaged with the C channels using at least one T-bolt which is slidingly engaged with the linear gap of the C channel.

In some embodiments, the base structure further comprises a deck retainer secured between the unit and a C channel such that the deck retainer is parallel with the C channel. The joist sockets in any embodiment provided are configured to secure to a second structure, which may be a supported work platform system.

In one embodiment, at least one unit of the base structure comprises four joists interconnected with four hubs. In another embodiment, the unit comprises at least two joists and each integration assembly is secured to one of the joists. The joists may contain a plurality of cage nuts and the C channels may comprise a plurality of apertures corresponding to the cage nuts so that the integration assemblies may be secured to the joists by a plurality of bolts, each bolt extending through an aperture of the C channels and engaging a corresponding cage nut.

A base structure according to the embodiments described here may include a plurality of units, each unit defined by four joists interconnected with four hubs, wherein the joists and hubs are interconnected such that the joists are copolanar with respect to one another. Each joist may comprise an upper element and a bottom element. The base structure may also include a plurality of integration assemblies, each integration assembly secured to the upper element of a joist and parallel to the joist. Each joist may further include a plurality of cage nuts, and each channeled structure a plurality of apertures corresponding to the cage nuts, such that the integration assemblies are secured to the joists using bolts extending through the apertures of the channeled structure and engaging the cage nuts.

In a further embodiment, the base structure further comprises a plurality of suspension connectors secured to the hubs.

According to a fourth general aspect, the present invention provides a suspended work platform system comprising: a plurality of joists, each having an upper element and a bottom element; and a plurality of hubs, wherein the plurality of joists comprises at least four joists and wherein the plurality of hubs comprises at least four hubs; wherein the joists and hubs are interconnected such that the joists are coplanar with respect to each other; a plurality of access structure integration assemblies, each integration assembly comprising a substantially linear deck retainer comprising a plurality of apertures, a substantially squared channeled structure parallel with the deck retainer comprising a solid, flattened bottom portion containing a plurality of apertures corresponding to the apertures of the deck retainer, two flattened side wall portions extending upward from the bottom portion at approximately right angles, each side wall portion terminating in a flange extending at a right angle from the side wall portions such that the flanges extend toward each other, and a linear gap having extending the length of the channeled structure and having a width; a plurality of deck retainer bolts extending through the corresponding apertures of the deck retainer and channeled structure; a plurality of joist sockets comprising a hollow tubular body and a base having a plurality of apertures; and a plurality of T-bolts extending through the apertures of the joist socket and into the linear gap of the channeled structure and having a head portion with a width greater than that of the linear gap, wherein the T-bolts are slidingly engaged with the channeled structure and each of the T-bolts is secured with a nut; wherein each channeled structure secures at least two joist sockets, wherein each integration assembly is secured to the upper element of one of the joists, and wherein the number of joists is greater than the number of integration assemblies.

In one embodiment of the third aspect, the joists comprise a plurality of cage nuts which engage the deck retainer bolts to secure deck retainer and channeled structure to joists.

The suspended work platform system may also include at least two suspension connectors, each secured to one of the hubs. At least one of the hubs may comprise a first surface with a set of openings; a second surface substantially parallel to the first surface, the second surface having a second set of openings; and a structural element connected between the first surface and second surface, wherein at least one of the first set and the second set of openings is co-axial with respect to one of the openings in the second set of openings.

In a further embodiment, the joist sockets of the suspended work platform system are configured to secure a second structure. The second structure may be a supported work platform system, and the suspended work platform system may be articulatable.

According to a fifth general aspect, the present invention provides an integrated system comprising a base structure; a second structure; and at least two access structure integration assemblies, each assembly comprising a channeled structure, which may be a C channel, and at least one joist socket slidingly engaged with the channeled structure; wherein the base structure is secured to the channeled structure, and wherein the second structure is secured to the joist socket. The integrated systems may also include a deck retainer. The base structure may be a work platform system, such as a suspended work platform system or an articulatable suspended work platform system. The base structure may comprise one or more units, with at least one unit comprising at least four joists, each having an upper element and a bottom element, wherein at least two of the joists include at least four cage nuts; and at least four hubs, wherein the joists and hubs are interconnected such that the joists are coplanar with respect to each other.

In one embodiment, each access structure integration assembly is secured to a joist such that the integration assembly is parallel with the joist. Each joist may further include at least two cage nuts, and each integration assembly may be secured to a joist using at least two bolts which each bolt engaging one cage nut.

In one embodiment of an integrated system, each channeled structure comprises a solid, flattened bottom portion, two flattened side wall portions extending upward from the bottom portion at approximately right angles, each side wall portion terminating in a flange extending at a right angle from the side wall portions such that the flanges extend toward each other, and a linear gap extending the length of the channeled structure and having a width. Each joist socket may therefore be slidingly engaged with the channeled structure by a T-bolt slidingly engaged with the linear gap of the channeled structure. In some embodiments, each joist socket comprises a hollow tubular body and a base. The integration assembly may comprise two joist sockets.

In an embodiment, the second structure is at least one unit of a work platform system, and the second structure may further be a supported work platform system or shoring. A supported work platform according to an embodiment may have at least two levels. The second structure may also include a barrier secured to it.

In a further embodiment, an integrated system further comprises a third structure, the third structure comprising at least four hubs; and at least four joists, each of the four joists configured to be interconnected with at least two of the four hubs; wherein the joists and hubs are configured to be interconnected so that (i) one of the joists—and two of the hubs—configured to remain stationary; (ii) two of the joists are rotatable; and (iii) two of the hubs—and one of the joists—are translatable; wherein the two stationary hubs are each connected to the second structure; wherein, when interconnected, the two rotatable joists, the two translatable hubs, and the one translatable joist can articulate from an initial position to a final position with respect to the stationary joist and the stationary hubs; wherein the at least four joists are substantially coplanar with respect to each other in the initial and final positions; wherein at least one of the joists is configured to be connected with at least one of the hubs using a pin to provide free rotation of the at last one joist with respect to the at last one hub about the pin; and wherein the free rotation is restricted by at least one of (i) an additional pin that is to be located proximate a perimeter of the at least one hub; and (ii) at least a portion of a platform when the platform is positioned with respect to the hubs and joists in the final position.

According to a sixth general aspect, the invention provides an integrated work platform system for suspending from an overhead structure, the system comprising: a first structure comprising at least two suspension connectors with a first end and a second end, wherein the second end is configured to secure to an overhead structure, a plurality of joists, each having an upper element and a bottom element, and a plurality of hubs, at least two of the hubs having a first surface with an opening configured to engage the first end of the suspension connectors, wherein the plurality of joists comprises at least four joists and wherein the plurality of hubs comprises at least four hubs and wherein the joists and hubs are interconnected such that the joists are coplanar with respect to each other; a plurality of integration assemblies, each secured to a joist and each integration assembly comprising a substantially linear deck retainer comprising a plurality of apertures, a substantially squared tubular C channel parallel with the deck retainer, each C-channel comprising (a) a solid, flattened bottom portion containing a plurality of apertures corresponding to the apertures of the deck retainer, (b) two flattened side wall portions extending upward from the bottom portion at approximately right angles, each side wall portion terminating in a flange extending at a right angle from the side wall portions such that the flanges extend toward each other, and (c) a linear gap extending the length of the C channel and having a width, a plurality of deck retainer bolts extending through the corresponding apertures of the deck retainer and C channel, a plurality of joist sockets comprising a hollow tubular body and a base having a plurality of apertures, and a plurality of T-bolts extending through the apertures of the joist socket and into the linear gap of the C channel and having a head portion with a width greater than that of the linear gap, wherein the T-bolts are slidingly engaged with the C channels and each of the T-bolts is secured with a nut; wherein each C channel secures at least two joist sockets; and a second structure having framework secured to the joist sockets.

The second structure may include a plurality of coplanar platforms, at least one additional platform parallel to, but not copolanar with, the platforms, and/or at least three parallel, non-coplanar platforms.

According to a seventh aspect, the present invention provides a method of integrated a second structure with respect to a base structure, the method comprising: providing a base structure; providing a second structure; providing at least two integration assemblies, each integration assembly comprising a channeled structure and a joist socket slidingly engaged with the channeled structure; securing the channeled structures of the integration assemblies to the base structure; and securing the joist sockets of the integration assemblies to the second structure.

The base structure may be a suspended work platform system or an articulatable suspended work platform system. The second structure may be a work platform system.

According to an eight aspect, the prevent invention provides a method of installing a supported work platform system with respect to a suspended work platform system, the method comprising: providing a suspended work platform system that is suspended from a structure, the suspended work platform system comprising a plurality of interconnected hubs and joists such the joists are coplanar with respect to each other; aligning a plurality of deck retainers parallel to a plurality of joists such that the number of deck retainers is less than the number of joists and the deck retainers are each parallel with respect to each other; aligning a plurality of channeled structures collinear with the deck retainers, wherein the channeled structures comprise a solid, flattened bottom portion containing a plurality of apertures corresponding to the apertures of the deck retainer, two flattened side wall portions extending upward from the bottom portion at approximately right angles, each side wall portion terminating in a flange extending at a right angle from the side wall portions such that the flanges extend toward each other, and a linear gap extending the length of the channeled structure, wherein each flange has an inner surface and an outer surface; securing the deck retainers and channeled structures to the joists using a plurality of bolts; providing a plurality of joist sockets, the joist sockets comprising a tubular body, a base with at least two apertures, one T-bolt projecting through each of the apertures such that the T-bolt is oppose that tubular body, and a nut partially engaged with each T-bolt; sliding each joist socket along the outer surface of one of the flanges such that the T-bolts pass through the linear gap; tightening the nuts so that the head of the T-bolts engage the inner surfaces of the flanges; and securing a first end of a supported work platform system frame member in each of the plurality of joist sockets.

In one embodiment, the method further comprises providing a work platform assembly on a second end of the supported work platform system frame members.

The method may also further include providing an articulatable work platform assembly comprising a plurality of hubs and a plurality of joists connected to the plurality of hubs; and articulating the articulatable work platform assembly from an initial position to a final position, the articulating including at least one of rotating and translating one or more of the plurality of joists with respect to one or more of the plurality of hubs; wherein the plurality of joists are substantially coplanar with respect to each other in the initial and final positions.

The foregoing and other features and advantages of the invention will be apparent from the following more particular description of embodiments of the invention. It is to be understood that both the foregoing general description and the following detailed description are exemplary, but are not restrictive, of the invention.

BRIEF DESCRIPTION OF THE DRAWINGS

The features of the present invention will best be understood from a detailed description of the invention and an embodiment thereof selected for the purposes of illustration and shown in the accompanying drawings in which.

DETAILED DESCRIPTION OF THE PREFERRED EMBODIMENT

Figure 1:
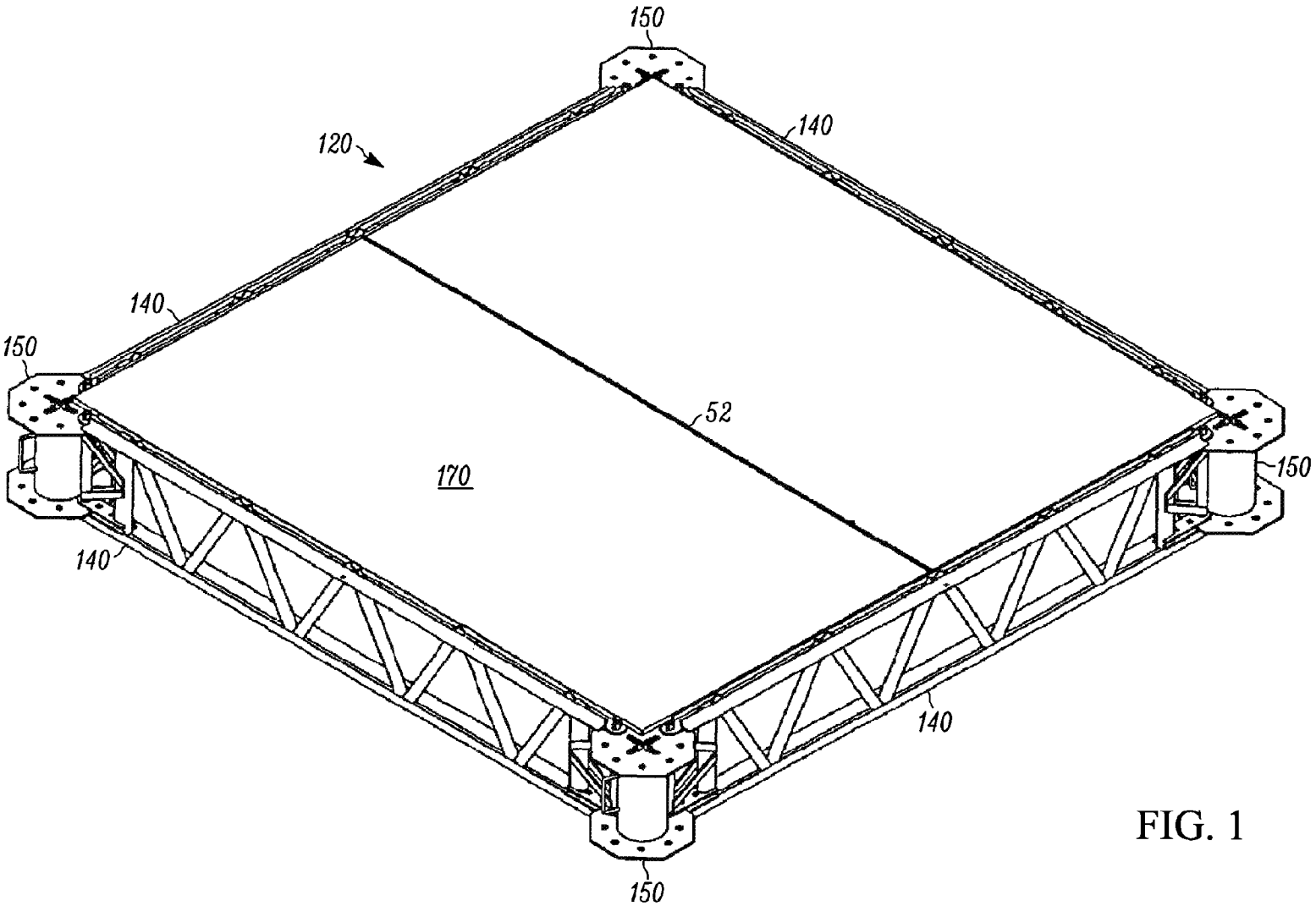
FIG. 1 is a top perspective view of an exemplary unit for a base structure.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise. Further, as used herein, the term "overhead structure" refers to any physical structure from which a work platform may be suspended. Similarly, the term "structure" refers to any physical structure which is accessible using a suspended work platform system, with or without an integrated supported work platform system. In some embodiments, a structure and an overhead structure may be the same. Exemplary structures and overhead structures include, but are not limited to, bridges, offshore rigs, boilers, boiler pendants, elevated and suspended structures, and ships.

Referring now to the drawings, FIG. 1 illustrates an exemplary unit 120 of a base structure 100. In the exemplary embodiment shown, unit 120, which is a unit of a first work platform system, includes four joists 140 joined by four hubs 150 such that joists 140 are coplanar and secured with hubs 150 at approximately right angles. Hubs 150 and joists 140, together with optional middle support deck joist 52, provide a framework to support a platform 170. In the exemplary embodiment shown, platform 170 is divided into two platforms 170A and 170B, with middle support deck joist 52 providing structural support between platforms 170A, 170B. In further exemplary embodiments, a single platform 170 may be used, or platform 170 may be subdivided into two, three or more platforms.

Figure 2:
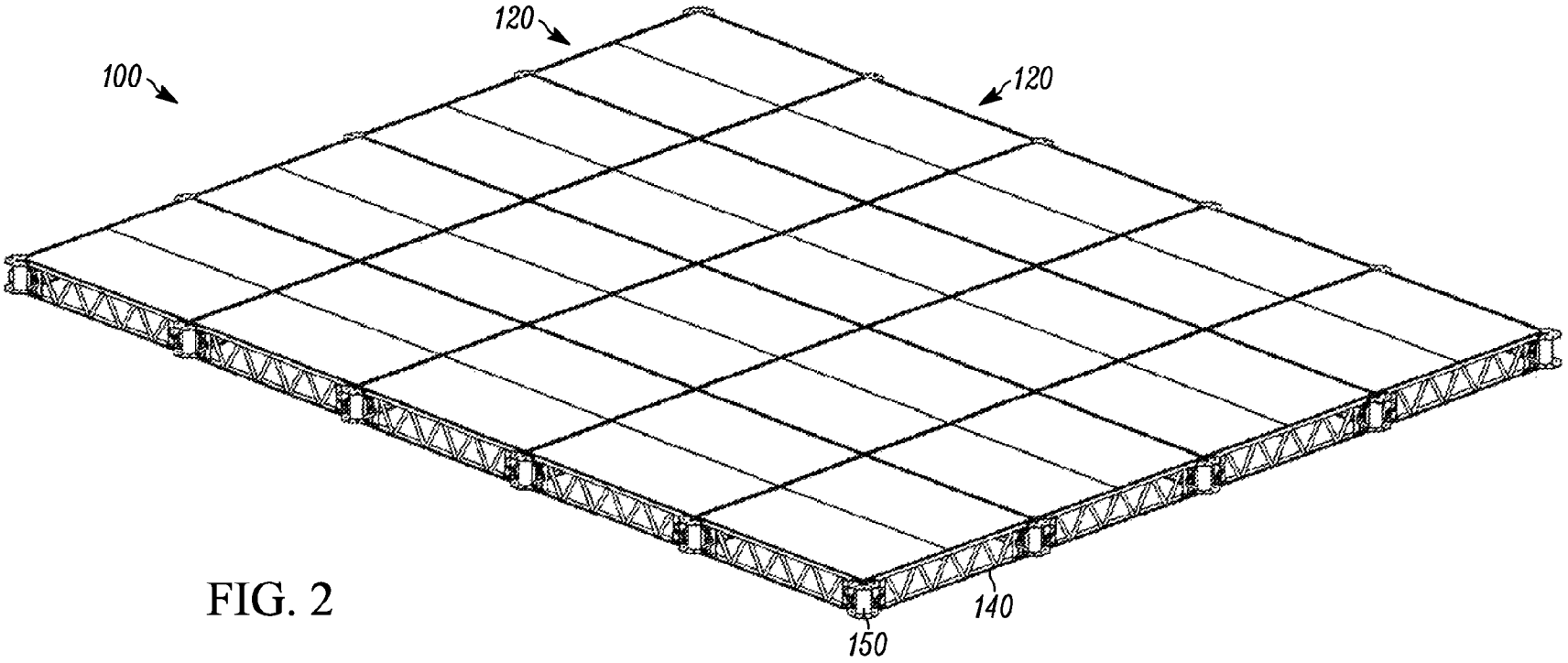
FIG. 2 is a top perspective view of an exemplary base structure.

FIG. 2 illustrates an exemplary base structure 100 comprising a plurality of units 120 joined together at hubs 150. In the exemplary embodiment shown, base structure 100 is a work platform system comprising a plurality of work platform units. In further exemplary embodiments, base structure 100 may be a single unit 120. In still further exemplary embodiments, base structure 100 may be any structure or system which provides a substantially planar surface having at least two coplanar joists 140 or a single joist 140 configured to have two coplanar portions, the portions not linear with respect to each other and separated by a distance.

A joist 140 is any elongate structural member adapted for bearing or supporting a load, such as a bar joist, truss, shaped-steel (i.e., I-beam, C-beam, etc.), or the like. A hub 150 is an interconnection structure, such as a node, hinge, pivot, post, column, center, shaft, spindle, or the like. One skilled in the art will therefore appreciate that size, shape and arrangement of hubs 150 and joists 140 may vary to provide a work platform unit 120 and system 100.

For example, the length of joists 140 and positioning of joists 140 and hubs 150 can vary depending on the desired size and configuration of base structure 100. While the exemplary embodiments shown, units 120 are rectangular, forming an overall rectangular base structure 100 with joists 140 in one direction being longer than the joists 140 extending in the opposite direction, joists 140 may be any length and joined with hubs 150 at any angle permitted by the design of hubs 150. The size and shape of support platforms 170A, 170B may similarly vary depending on the configuration of joists 140 and hubs 150.

In the exemplary embodiments shown in FIGS. 1 and 2, base structure 100 is shown as an access structure, such as a work platform system. Specifically, base structure 100 is shown as a work platform system designed to be suspended from an overhead structure (i.e., a suspended work platform system). However, the base structure 100 may be any base structure, as discussed above, including any type of access structure (i.e., suspended work platform system, supported work platform system, scaffolding, shoring). In preferred exemplary embodiments, base structure 100 is any structure having at least one unit 120 having two coplanar, parallel joists 140. More preferably, base structure 100 is a work platform system, and even more preferably a suspended work platform system. In a most preferred embodiment, base structure 100 is an articulatable suspended work platform system as described herein.

Figure 3:
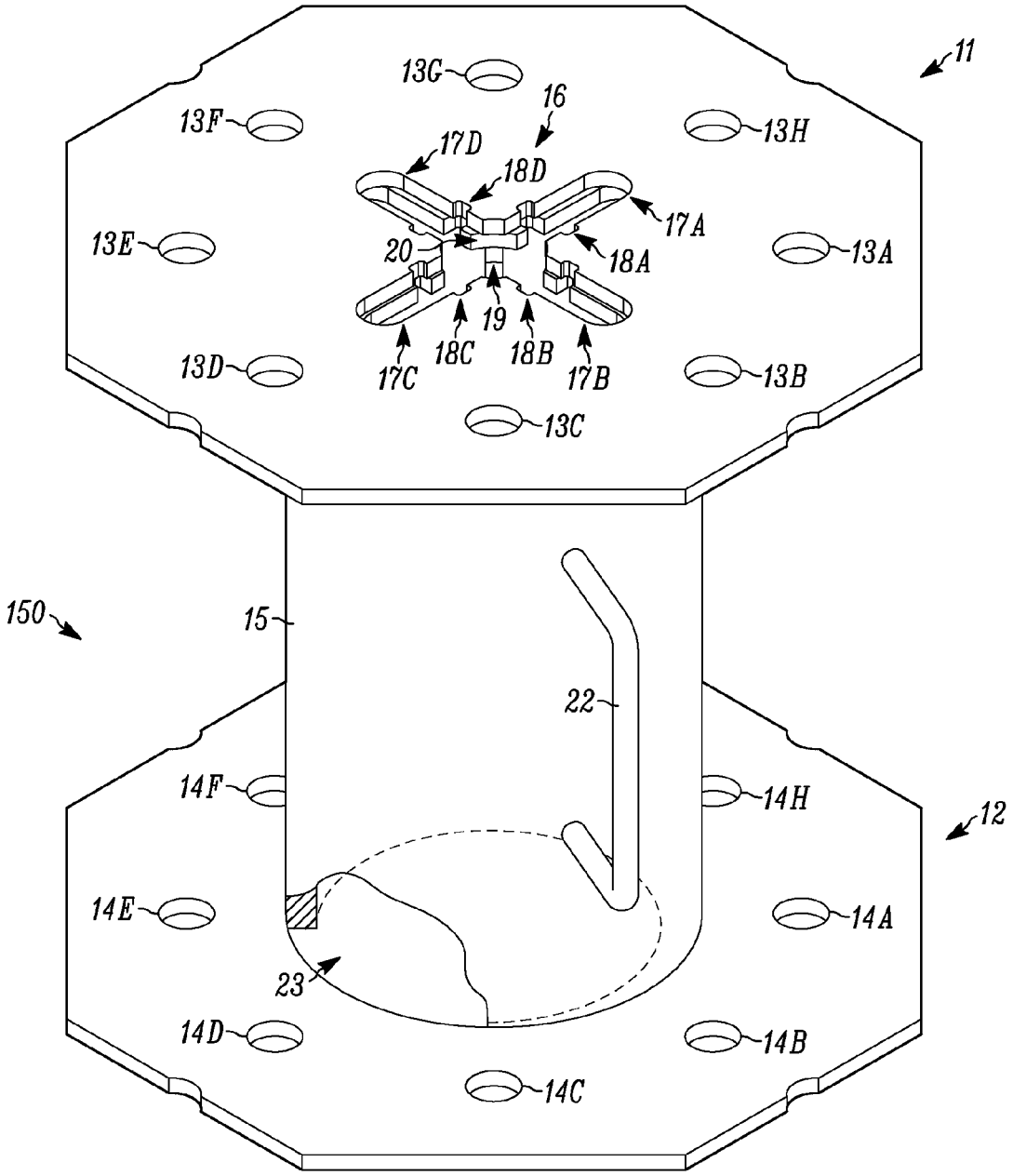
FIG. 3 is an exemplary hub for use with the base structure of FIG. 2.

FIG. 3 illustrates an exemplary hub 150 for use with a base structure 100, which in the exemplary embodiment described is an articulatable suspended work platform system. In the exemplary embodiment shown, hub 150 is configured so that, when attached to a joist 140, it allows for articulation of both the hub 150 and the joist 140. Articulation, as used herein, is defined as the capability to swing, and/or rotate, about a pivot point or axis. Hub 150 also permits unit 120, and subsequently a base structure 100, to be suspended from an overhead structure. However, in further exemplary embodiments, hub 150 may provide for articulation of only hub 150 or joist 140, or allow no articulation. In still further exemplary embodiments, hub 150 may not permit suspension of the unit 120 or base structure 100.

In the exemplary embodiment depicted in FIG. 3, showing a hub 150 which permits articulation of both the hub 150 and the joist 140 as well as suspension of a unit 120 and base structure 100, the hub 150 includes a top element 11 and a bottom element 12 spaced at distal ends of a middle section 15. The top element 11 and bottom element 12 may be substantially planar in configuration as well as being parallel to each other. The top element 11 and bottom element 12, in the embodiment shown, are octagonal. The middle section 15 may be a cylindrical section wherein a longitudinal axis of the middle section 15 is normal to the planes of the top element 11 and bottom element 12. In the embodiment shown, the middle section 15 is a right circular cylinder. In the exemplary embodiment shown, a lower portion of the middle section 15 is removed for clarity purposes to show that the middle section 15 is hollow.

There are a plurality of openings 13, 14, extending through both the top element 11 and bottom element 12, respectively. The plurality of openings 13 (e.g., 13A, 13B, 13C, 13D, 13E, 13F, 13G, 13H) are interspersed on the top element 11 so as to offer various locations for connecting to one, or more, joists 140. The plurality of openings 14 (e.g., 14A, 14B, 14C, 14D, 14E, 14F, 14G, 14H) are similarly spaced on the bottom element 12 so that respective openings (e.g., 13A and 14A) are coaxial.

Figure 4:
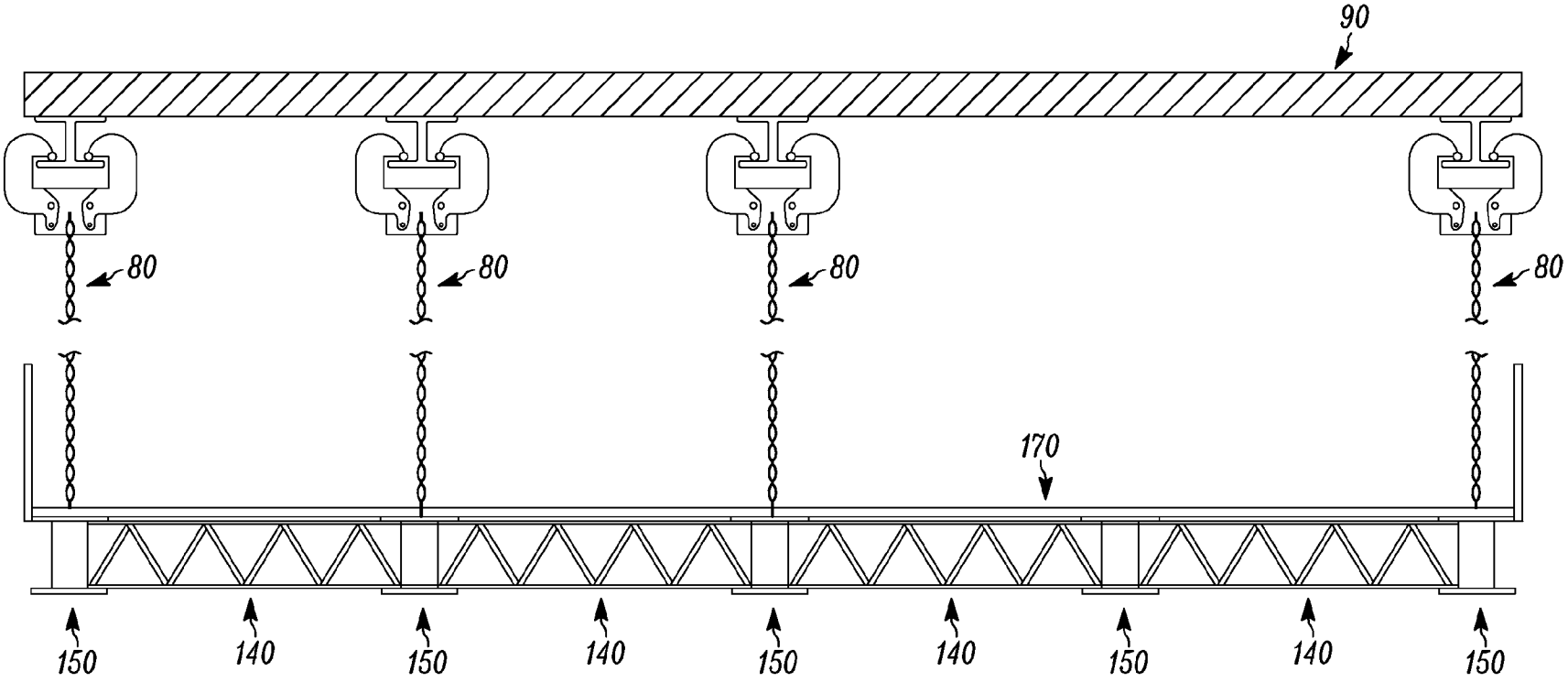
FIG. 4 is a side view of base structure suspended from an overhead structure.

At the center of the top element 11 is a center opening 16 which is configured to receive a suspension connector for securing a unit 120 and base structure 100 to an overhead structure. The center opening 16 may be generally cruciform in configuration due to its center opening area 19 with four slots 17 (e.g., 17A, 17B, 17C, 17D) extending therefrom. Transverse to each of the four slots 17A, 17B, 17C, 17D, and interconnected thereto, are a series of cross slots 18A, 18B, 18C, 18D. Slots 17, 18 and center opening area 19 interact with and secure one end of a suspension connector 80 to hub 150, as shown in FIG. 4. The other end of suspension connector 80 secures to an overhead structure 90 to suspend a base structure 100. One skilled in the art will readily appreciate that slots 17, 18 and center opening area 19 may have other configurations and designs so long as a suspension connector 80 can engage hub 150.

For added strength a second reinforcing plate 20 may be added to the underside of the top element 11 wherein openings on the reinforcing plate 20 correspond to the center opening 16 configuration and all the ancillary openings thereto (17, 18, 19). A handle 22 is optionally added to the side of the middle section 15.

Figure 5:
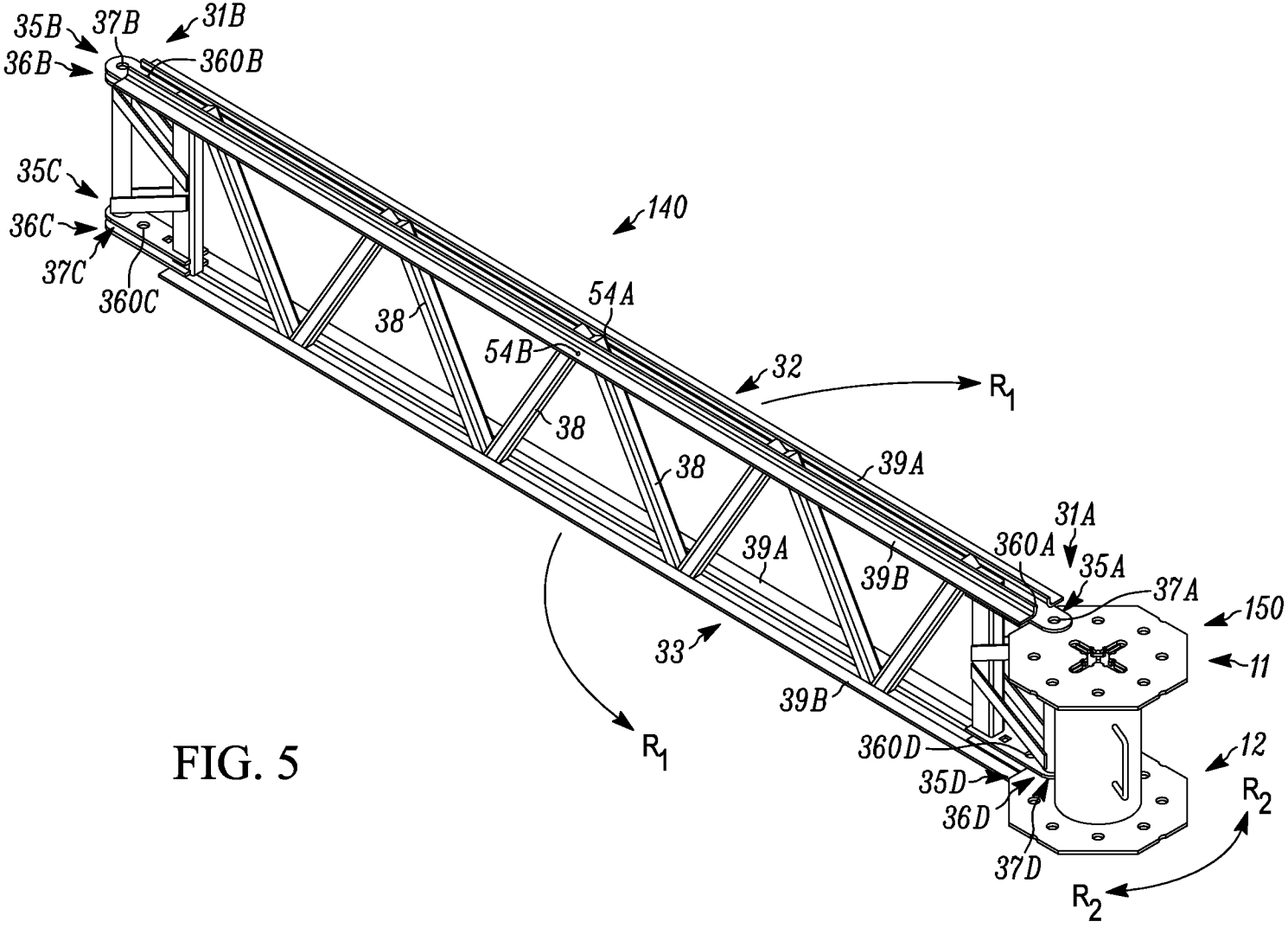
FIG. 5 is a top perspective view of the hub of FIG. 3 connected with a joist.

FIG. 5 depicts a top perspective view of the interconnection between a single hub 150 and a single joist 140. The exemplary joist 140 illustrated in FIG. 5 includes an upper element 32 and a bottom element 33. Interspersed between elements 32, 33 are a plurality of diagonal support members 38. Each element 32, 33 is made of two L-shaped pieces of angle iron 39A, 39B called joist chords. Elements 32, 33 typically may be identical in construction, with the exception being upper element 32 includes connector holes 54A, 54B at its midspan. The joist 140 includes a first end 31A and a second end 31B. At either end 31A, 31B of both the upper element 32 and bottom element 33 extends an upper connecting flange 35 and a lower connecting flange 36. Through both upper and lower connection flanges 35, 36 are connecting holes 37. Thus, there are four upper connecting flanges 35A, 35B, 35C, 35D and four lower connecting flanges 36A, 36B, 36C, 36D. Thus, at a first end 31A, extending from the upper element 32, is an upper connection flange 35A and lower connection flange 36A, with a connecting hole 37A therethrough. Similarly, at the second end 31A of the upper element 32, extends an upper connection flange 35B and lower connection flange 36B, with a connecting hole 37B therethrough. Continuing, at the first end 31A of the lower element 33 extends an upper connection flange 35D and lower connection flange 36D. Through these connection flanges 35D, 36D are a connecting hole 37D. At the second end 31B of the joist 30 extending from the lower element 33 is an upper connection flange 35C and lower connection flange 36C with a connecting hole 37C therethrough.

Interior to each of the connector holes 37A, 37B, 37C, 37D are additional locking holes 360A, 360B, 360C, 360D also located on the connection flanges 35A, 35B, 35C, 35D. A pin may be placed through the connecting holes 37 and any two corresponding top and bottom openings 13, 14 of hub 150. For example, a pin may be placed in through an upper connection flange 35A; through an opening 13A; through a lower connection flange 36A (all of the first end 31A of the upper element 32); through an upper connection flange 35D; through an opening 14A; and, then through the lower connection flange 36D. In this scenario, the pin further threads through connecting holes 37A, 37D. The pin may include two roll pins at its upper end, the lower of the two roll pins acting as a stop, thereby preventing the pin from slipping all the way through joist 140 and hub 150. The upper roll pin may act as a finger hold to allow easy maneuvering of the pin.

The design of these parts is such that free rotation of both the joist 140 and hub 150 is allowed, even while joist 140 and hub 150 are connected together. Rotational arrow $R_1$ shows that rotation of the joist 140 while $R_2$ shows rotation of the hub 150. These rotational capabilities provide, in part, the articulating capability of the joists 140 and hubs 150.

As will be appreciated by those skilled in the art, joists 140 can be of any length and positioned at any angle which may be accommodated by hub 150. When multiple hubs 150 and joists 140 are joined, such as in the case of a single unit 120 or a base structure 100, joists 140 may be pivotal on hubs 150 to create any configuration of units 120 and therefore base structure 100. Because of this articulation, the framework of units 120 may also be assembled in a collapsed form while a base structure 100 is in place and then expanded outward from the base structure 100. Once in a desired configuration, the unit 120 is secured to prevent further articulation.

Figure 6:
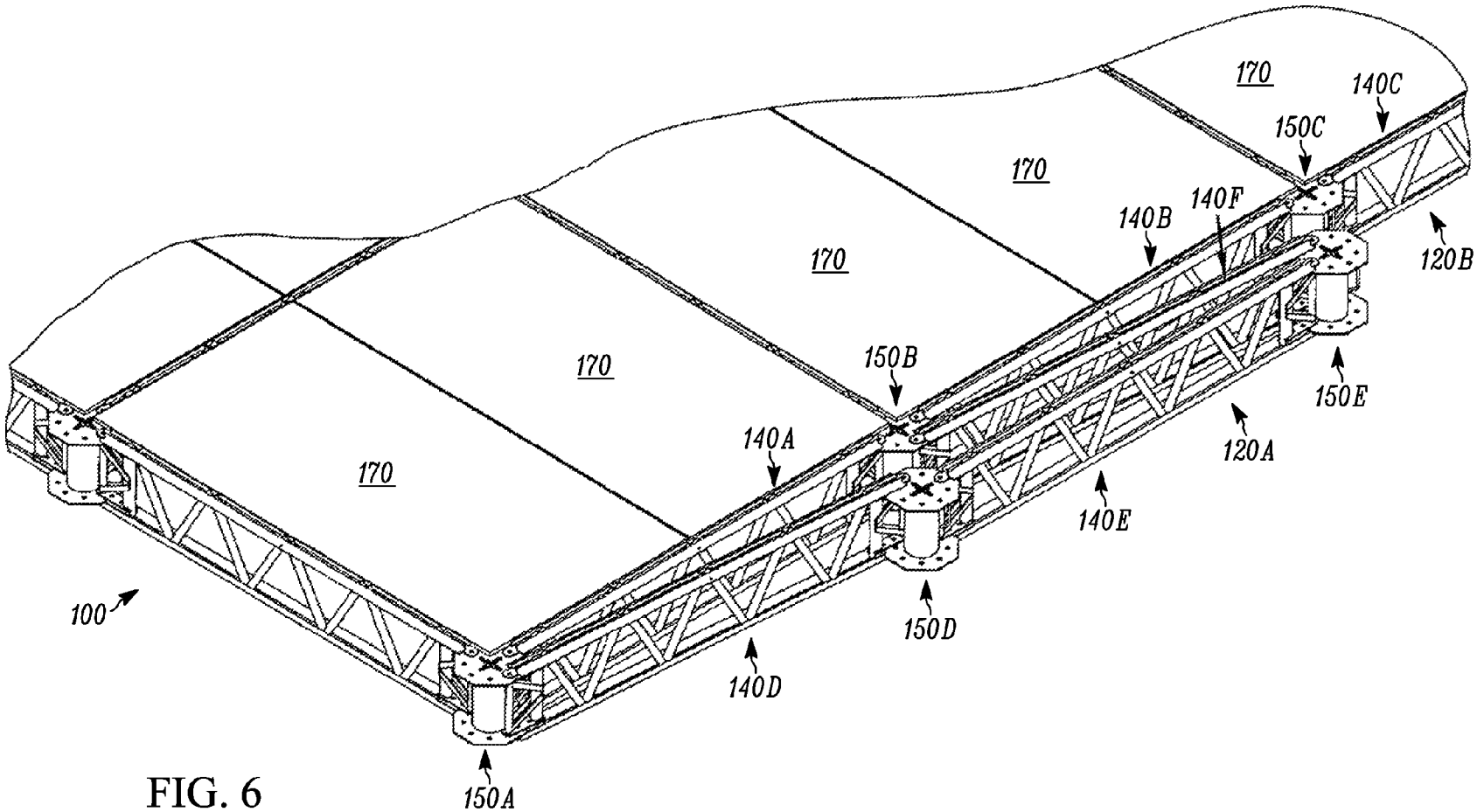
FIG. 6 is a top perspective view of a base structure and a unit frame prior to articulation.
Figure 7:
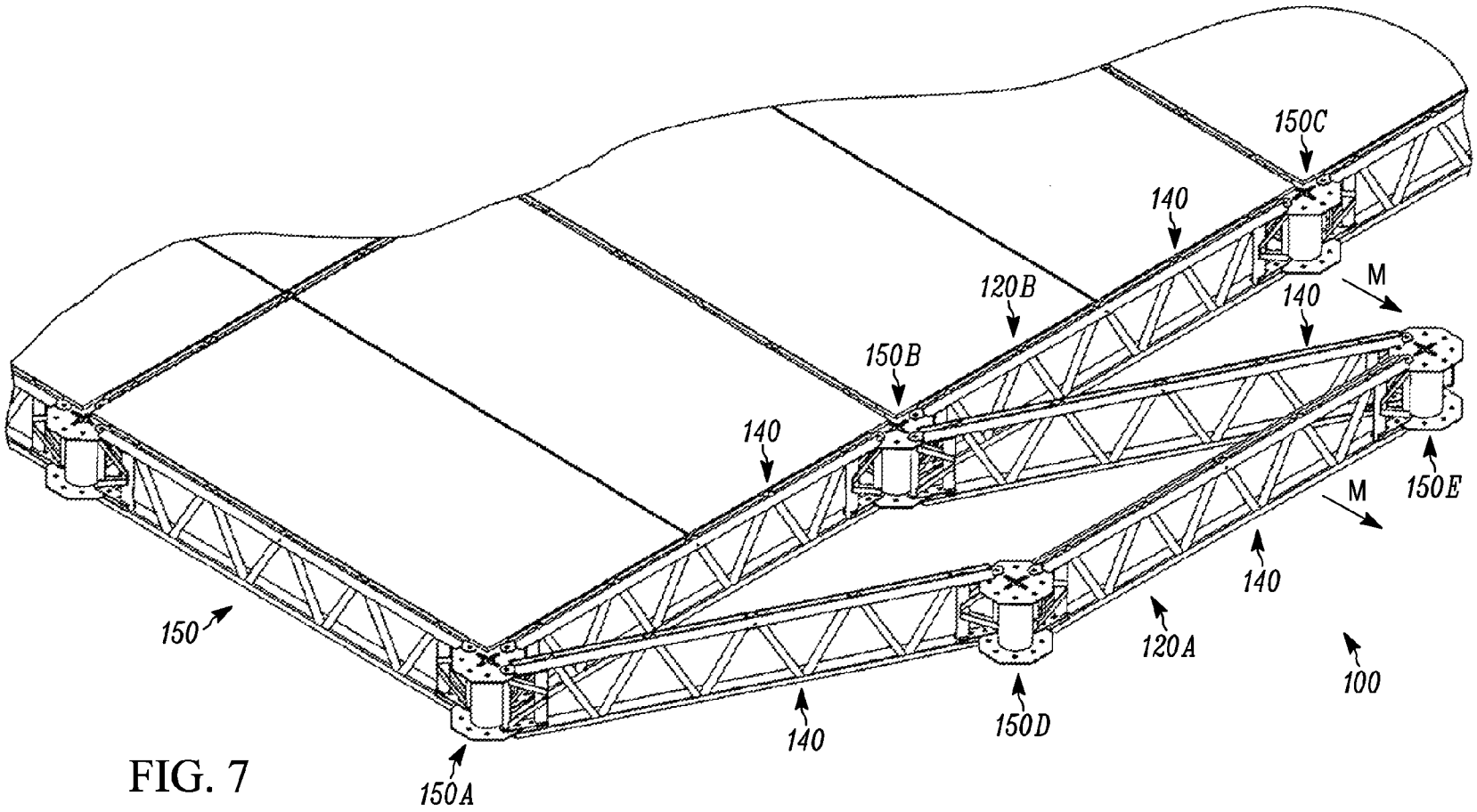
FIG. 7 is a top perspective view of the embodiment of FIG. 6 undergoing articulation.
Figure 8:
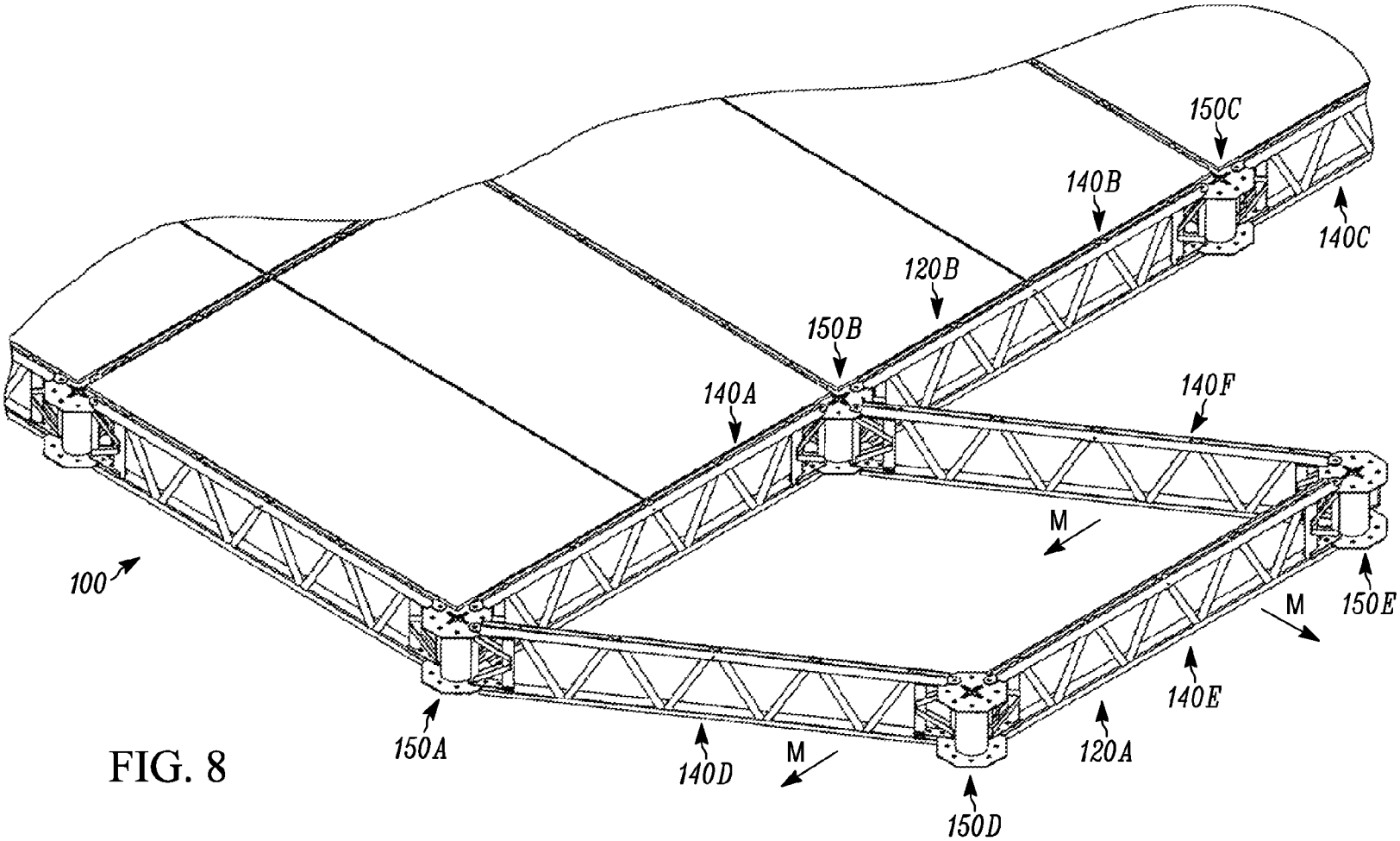
FIG. 8 is a top perspective view of the embodiment in FIG. 7 undergoing further articulation.
Figure 9:
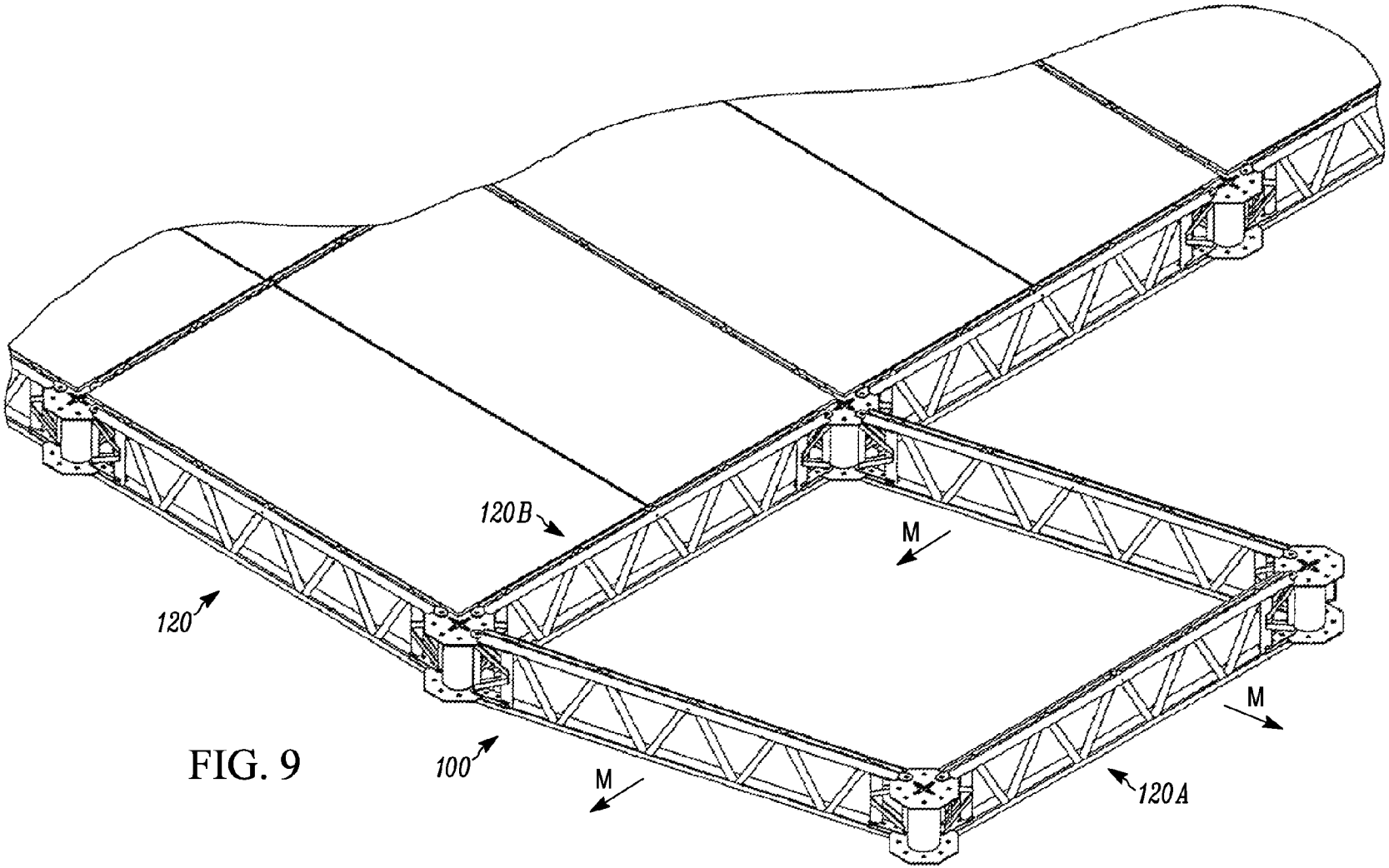
FIG. 9 is a top perspective view of the embodiment of FIG. 8 undergoing further articulation.
Figure 10:
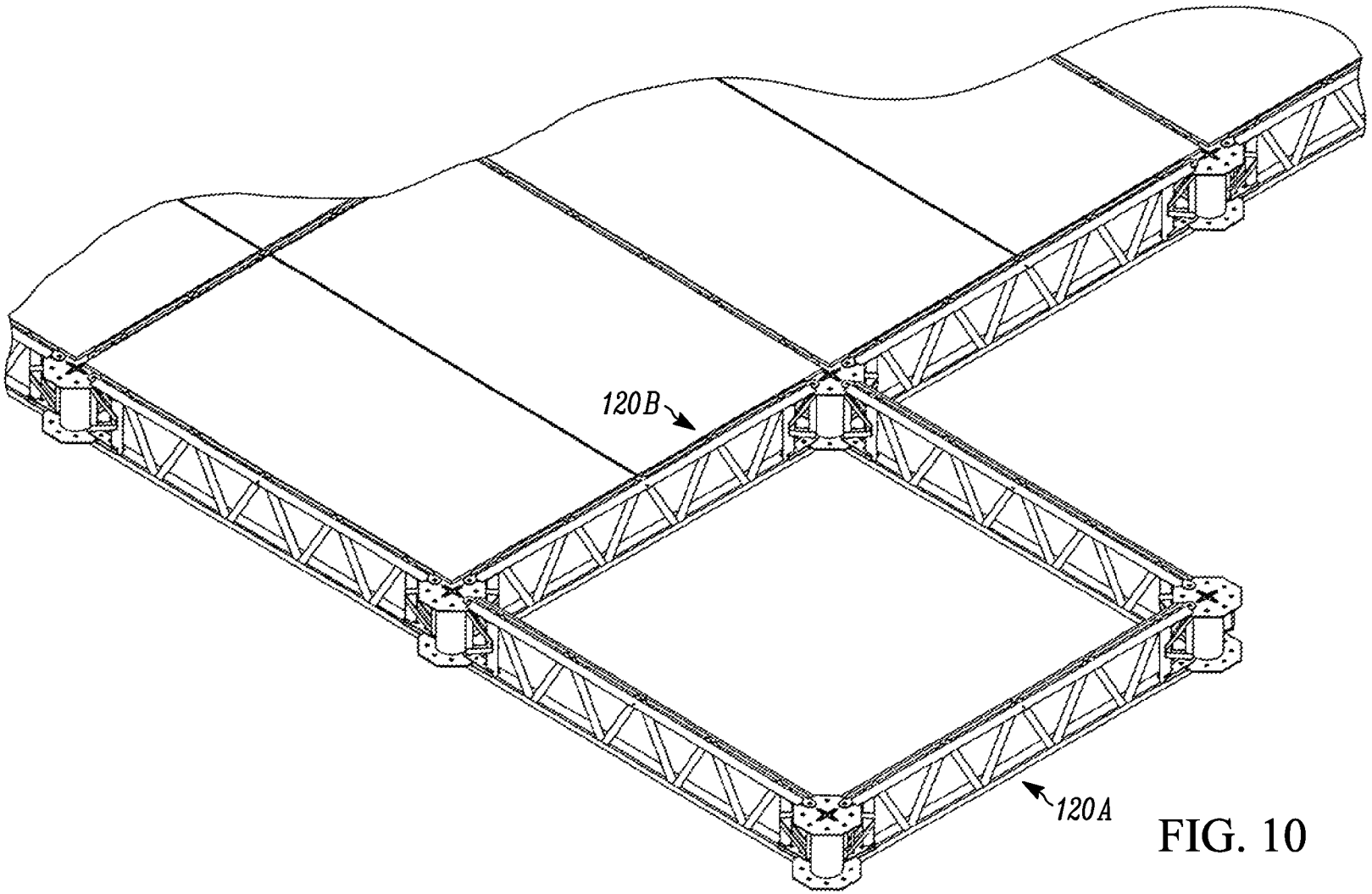
FIG. 10 is a top perspective view of the embodiment in FIG. 6 having completed articulation.

This "in-the-air" assembly of further units 120 is illustrated in FIGS. 6-10. FIG. 6 shows an exemplary framework for a unit 120A assembled and joined to an existing base structure 100 at unit 120B. The new unit 120A is in its initial position, prior to articulation. As FIGS. 7-9 clearly show through the motion arrows "M," by a combination or rotation of joists 140D, 140E and 140F, and hubs 150D and 150E, the framework for unit 120A is able to move and rotate into its final requisite position (FIG. 10). That is, the unit 120A articulates into place.

Once in position, unit 120A may be locked into its final position using locking pins as described above. In further exemplary embodiments, further articulation of unit 120A may be prevented by securing a platform 170 (not shown) in the framework.

In alternative embodiments, joist 140 and hub 150 may be secured to each other using other structures and methods known in the art and may not allow articulation of the joist 140 and hub 150 relative to each other. For example, in some embodiments, joist 140 and hub 150 may be securely joined and locked into place such that articulation is prevented.

Figure 11:
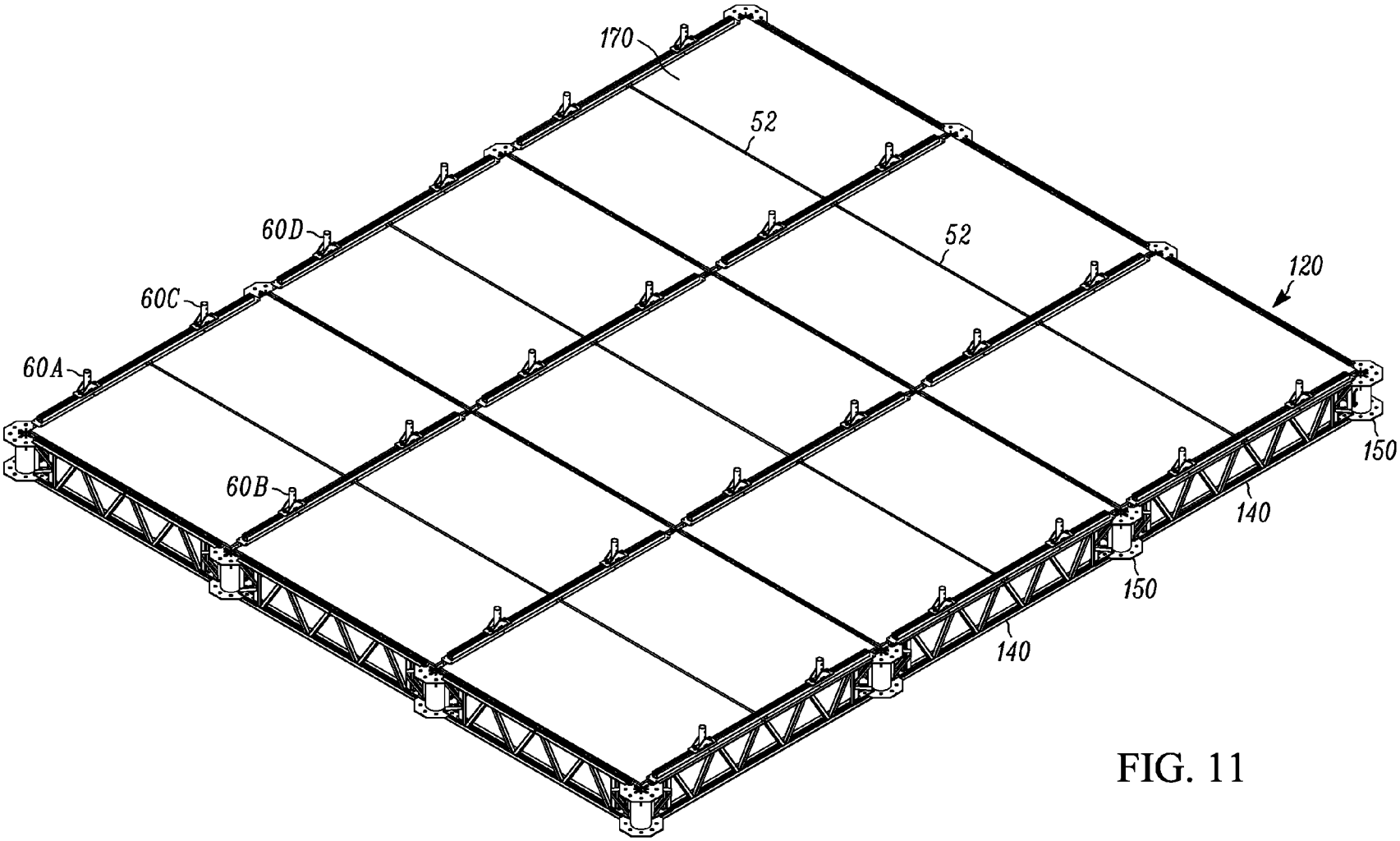
FIG. 11 is a top perspective view of an exemplary base unit with multiple integration assemblies.

FIG. 11 is a top perspective view of an exemplary base structure 100 as shown in FIG. 2 with access structure integration assemblies 300 secured to some joists 140. As discussed in more detail below, access structure integration assemblies 300 include at least one joist socket 60 and channeled structure 50, which in the exemplary embodiment shown are secured to joists 140 running perpendicular to middle support deck joists 52. Access structure integration assemblies 300 are used to integrate a second structure 200, or unit 220 or framework 210 of a second structure, to a base structure 100 or unit 120 of a base structure.

In one embodiment, the second structure 200 may be any structure capable of being integrated using access structure integration assemblies 300, such as, for example, any access structure. Access structures include, for example, suspended work platform system, supported work platform system, scaffolding, and shoring.

As illustrated, joist sockets 60 are arranged on channeled structures 50 which run parallel with and are secured to joists 140. The size of base structure 100, and specifically the arrangement of joists 140, therefore necessarily limits the configuration of joist sockets 60 and, ultimately, a second structure 200 which is integrated with base structure 100. In the exemplary embodiment shown, channeled structures 50 are secured to joists which are perpendicular to middle support deck joists 52. However, in further exemplary embodiments, channeled structures 50 may be secured to joists parallel to middle support deck joists 52 or both.

To save materials and assembly time and cost, channeled structures 50 are typically secured to joists 140 running in a single direction, such as those running perpendicular to middle support deck joists 52 as shown in FIG. 11. The distance between two joist sockets 60 on a given linear path of joists 140 (such as joist sockets 60A, 60C and 60D) is therefore variable, while the distance between joist sockets 60 on parallel joists (such as joist sockets 60A and 60B) remains the same. Typically, the length of joists 140 extending perpendicular to channeled structures 50 is equal to (or a factor or multiple of) the desired length of one dimension of a second structure 200.

In some exemplary embodiments, second structure 200 is a work platform system, and the length of joists 140 extending perpendicular to channeled structures 50 is equal to (or a factor or multiple of) the bay size of the work platform system or the length of a frame member for the work platform system. In a preferred exemplary embodiment, the second structure 200 is a supported work platform system. The bay size of most supported work platform systems, and therefore the length of most frame members for supported work platform systems, can be 3 feet, 42 inches, 4 feet, 5 feet, 7 feet, 8 feet or 10 feet. The joists 140 of a base structure 100 which will be integrated with a second structure 200 which is a supported work platform system may therefore be preferably 3 feet, 42 inches, 4 feet, 5 feet, 7 feet, 8 feet or 10 feet in length.

Figure 12:
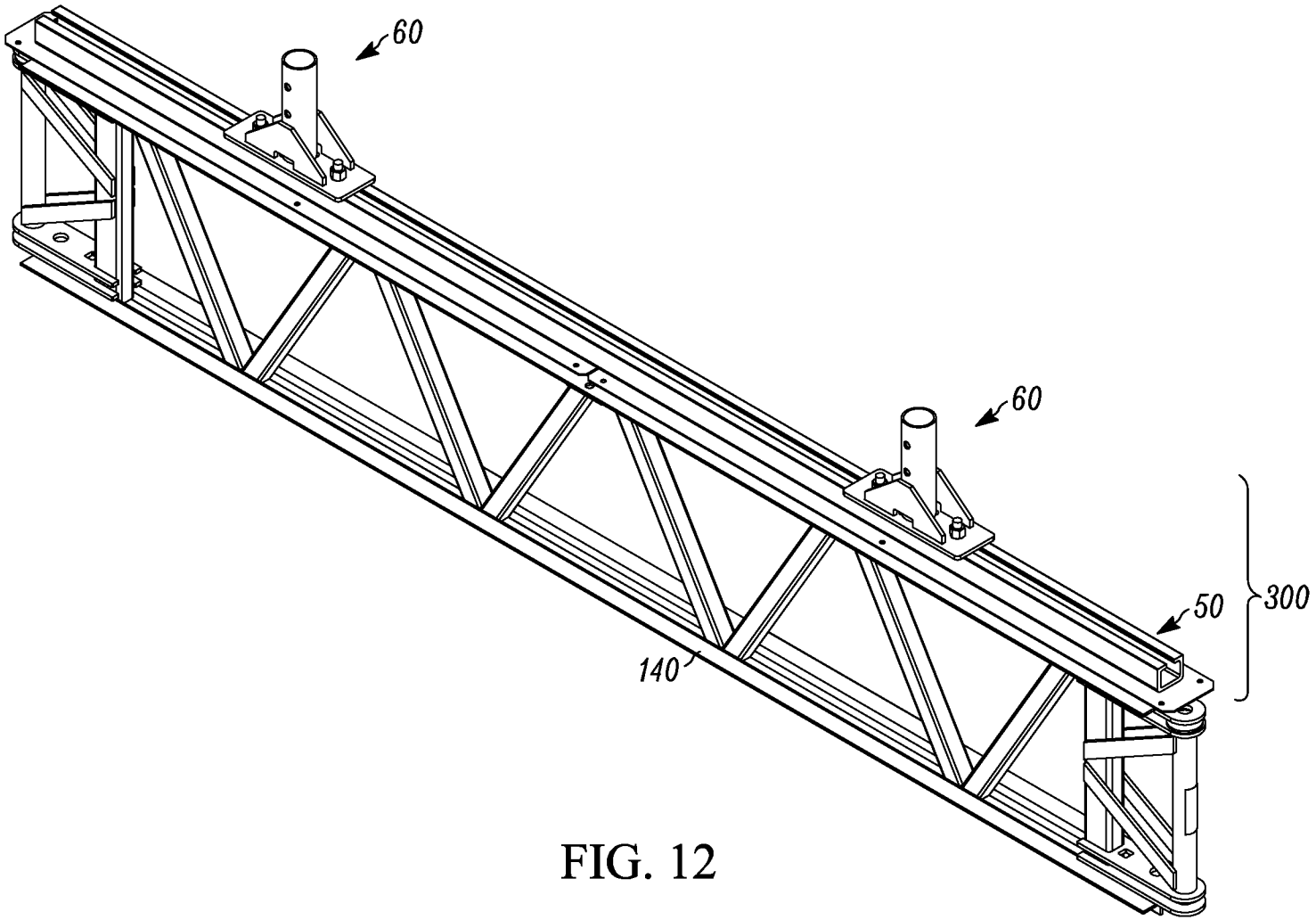
FIG. 12 is a top perspective view of a joist containing an access structure integration assembly.
Figure 13:
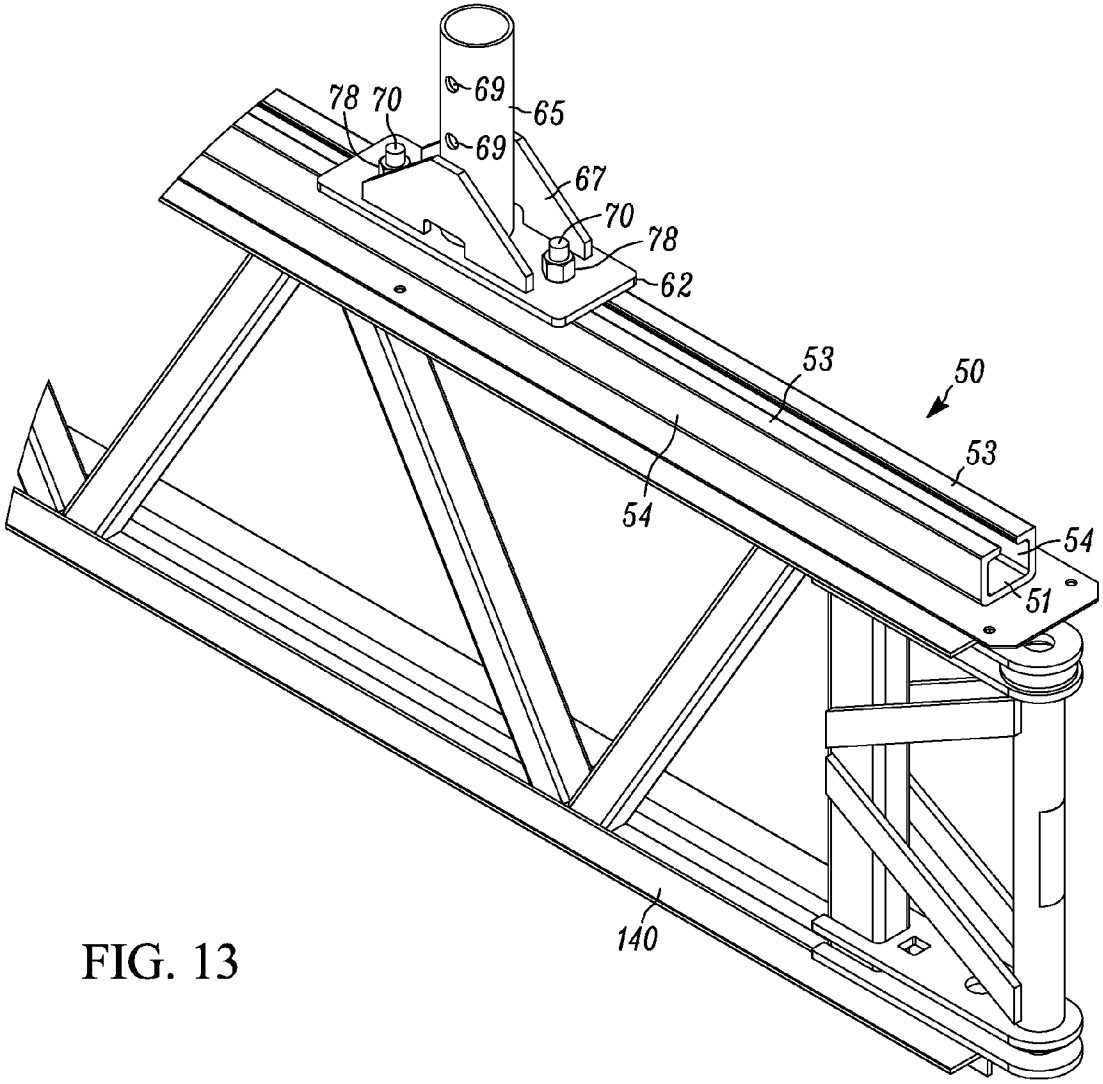
FIG. 13 is a detailed view of a joist socket.

FIG. 12 illustrates an exemplary joist 140 with an access structure integration assembly 300 comprising a single channeled structure 50 and two joist sockets 60. FIG. 13 shows the junction between a channeled structure 50 and joist socket 60 in more detail. As more fully described below, joist sockets 60 may be positioned and secured anywhere along channeled structures 50.

In the exemplary embodiments shown, channeled structure 50 is a substantially squared tubular structure having a solid, flattened bottom portion 51 with solid, flattened side walls 54 extended upward from bottom portion 51 at approximately right angles. Each side wall 54 terminates in a flange 53 which is at an approximate right angle inward from side walls 54 such that the flanges 53 extend towards each other but are not in physical contact with each other to form a linear gap the length of channeled structures, thereby creating a "C" shape. The inner and outer surfaces of flanges 53 are substantially planar. In some embodiments, the channeled structure 50 is referred to as a C channel 50.

In the exemplary embodiments shown, C channel 50 is secured to joist 140 with deck retainer 58 between the joist 140 and C channel 50. Deck retainer 58 is a substantially linear, solid structure which transfers and distributes force from a second structure 200 integrated with the base structure 100 using integration assemblies 300 along joist 140, and specifically to joist chords 144. When joist socket 60 is used on an end joist, a toe board may be used instead of deck retainer 58.

In the exemplary embodiment shown in FIG. 12, two deck retainers 58 are required to span the length of joist 140 while a single C channel 50 is used. In further embodiments, deck retainers 58 and C channels 50 may be of any length as long as the apertures of each align with the cage nuts 142 of the joists 140 so that the integration assemblies 300 may be secured to joists 140.

Joist socket 60 includes tubular body 65 structurally integrated as a single unit with base 62 and supporting braces 67. Tubular body 65 is configured to receive a framework 210 from a second structure 200 to integrate the second structure 200 with the base structure 100. In the exemplary embodiments described, the framework 210 is cylindrical to correspond to tubular body 65 of joist socket 60. However, it should be understood that the shape and size of tubular body 65 may vary to accommodate any shape of framework 210 for a second structure 200 or unit 220 of a second structure.

T-bolts 70 with nuts 78 secure joist socket 60 in C channel 50 while still permitting joist socket 60 to slidingly engage C channel 50. As used herein, slidingly engaged means that two components (i.e., a joist socket and C channel) are secured to each other in a manner permitting sliding movement relative to one another. As will be shown in FIGS. 16 and 17, T-bolts 70 have a T-like shape such that the bolt head 72 is shaped to slide within C channel 50 and engage with the inner surface of flanges 53. When joist socket 60 is at a desired location on C channel 50, nuts 78 are tightened on T-bolts 70 to lock joist socket 60 in place. When nuts 78 are loosened, T-bolts are able to freely slide within the linear gap of C channels 50, and joist sockets 60 are therefore slidingly engaged with C channels 50.

As will be shown, apertures 69 on joist socket 60 align with apertures in a supported work platform system component, such as a leg, to secure a supported work platform system to suspended work platform system 100.

In the exemplary embodiment shown, joist socket base 62 has a width just greater than that of C channel 50 and a length sufficient to support a single tubular body 65. However, it may be understood that joist socket base 62 may be of any length to include one or more tubular bodies 65, and the diameter of tubular body 65 is dependent on the dimension of the leg or other component of a supported work platform system which will be engaging joist socket 60. Further, the width of joist socket base 62 may permissibly vary depending on the diameter of tubular body 65 keeping in mind that T-bolt 70 must still fully engage base 62.

As will be appreciated by one skilled in the art, when integrating a second structure 200 with base structure 100, framework 210, such as the legs of a second structure, will need to distributed weight to the joists 140. The strongest portions of joists 140 are panel points 144 (shown more clearly in FIGS. 14A and 14B) where diagonal support members 38 intersect. Traditionally, dunnage, such as I-beams or other supportive materials, is placed over joists 140 to transfer the load of a second structure to the panel points 144. However, as discussed above, such dunnage systems prevent downward movement and provide little resistance to horizontal, vertical and rotational movement. Additional securing devices (i.e., tie-downs, bracing, guy lines, etc.) are therefore used to more securely support a second structure on a base structure.

By securing deck retainer 58 and channeled structure 50 directly on top of and parallel with joists 140, the load of a supported work platform system is concentrated at joist sockets 60 and transferred by the channeled structures 50 to panel points 144. Further, because joist sockets 60 completely enclose the ends of frame members for a supported work platform system, movement in all directions (including rotational movement) is prevented.

In the exemplary embodiments shown, access structure integration assembly 300 secures a second structure 200 to prevent or limit movement in more than just the downward direction. For example, in the exemplary embodiment described, joist socket 60 will prevent movement of framework 210 secured in it all directions along the x axis, y axis and z axis, including rotationally in each axis for a total of six potential types of movement, relative to joist 140 when joist socket 60 is secured in channeled structure 50. However, in further exemplary embodiments, integration assembly 300 may limit or prevent movement in at least one, preferably at least two, and more preferably at least three of the above directions. In the most preferred embodiment, however, all six types of movement of a frame member 210 (and therefore second structure 200) relative to joist 140 (and therefore base structure 100) is limited or prevented by integration assembly 300.

Figure 14A:
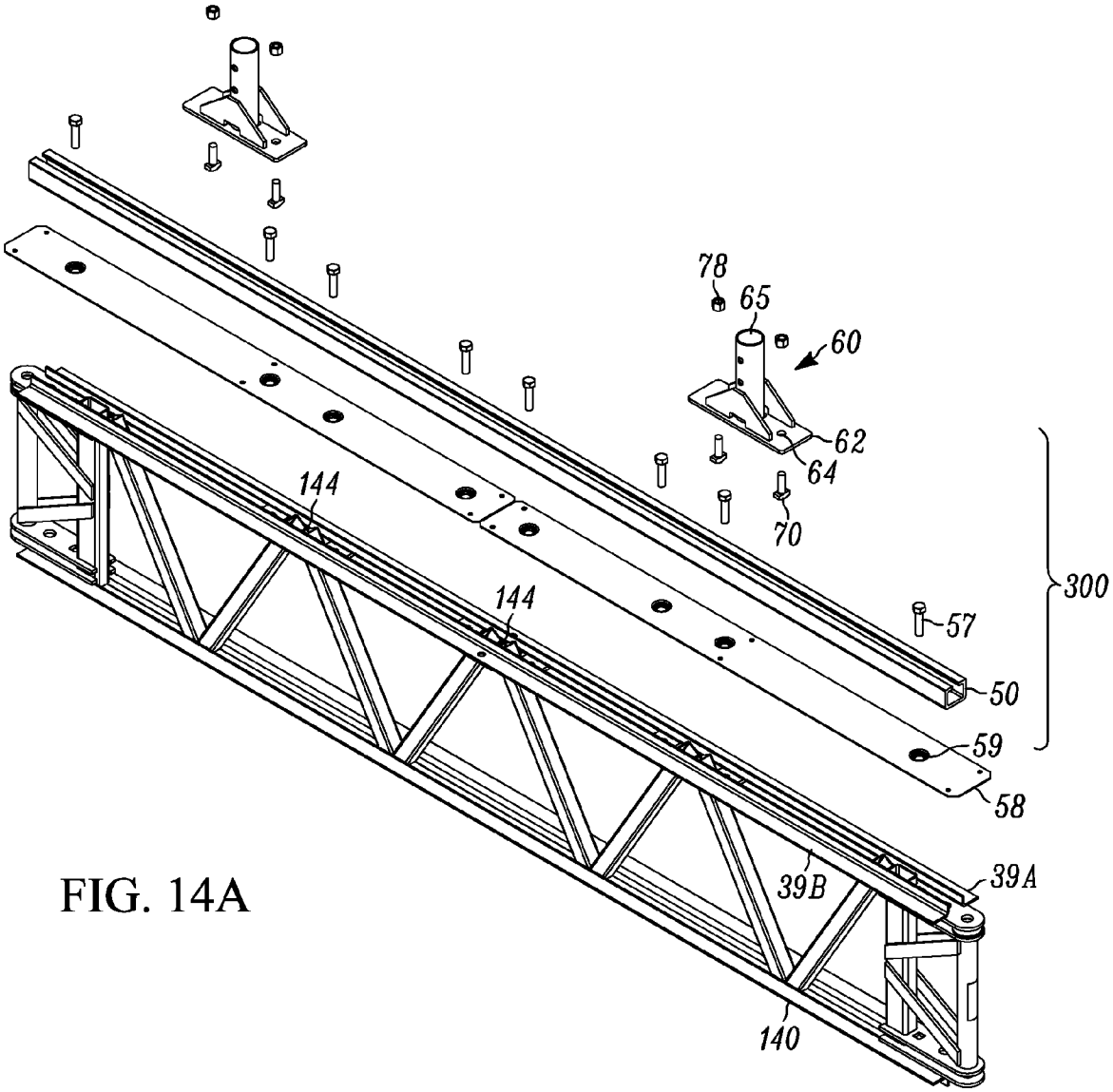
FIGS. 14*a* and 14*b* are exploded views an exemplary integration assembly.
Figure 14B:
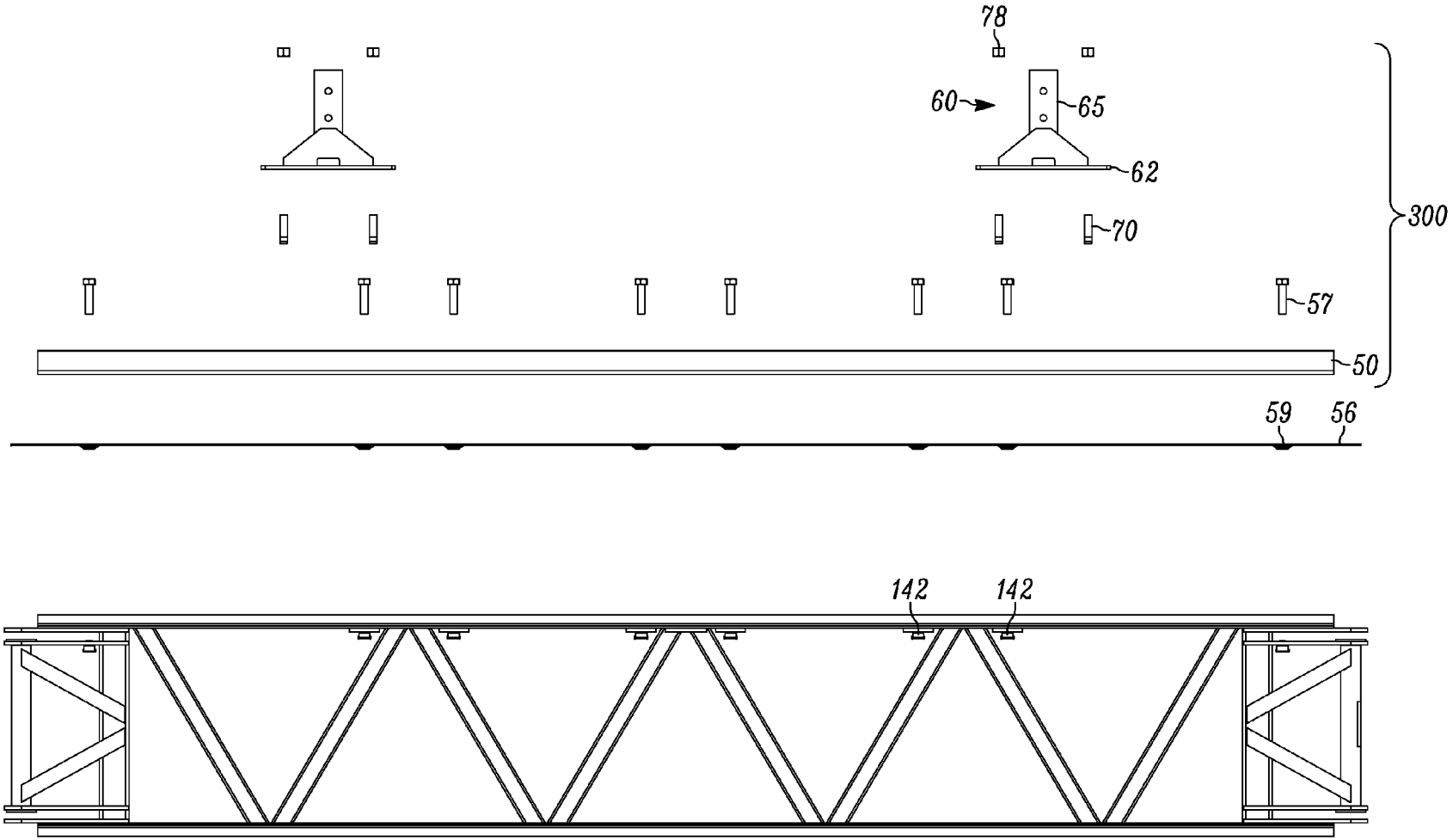

FIGS. 14A and 14B show an exploded view of the joist 140 with access structure integration assembly 300. In the exemplary embodiment shown, integration assembly 300 comprises joint socket 60 and channeled structure 50, which in the exemplary embodiment shown is a C channel. Although the bracket denoting integration assembly 300 as illustrated in FIGS. 14A and 14B encompass nuts 78, T-bolts 70 and deck retainer bolts 57, it is understood that these components do not form essential components of an integration assembly 300 as described herein. Other securing components and mechanisms may be used to secure a C channel 50 (and deck retainer 58, when used) to a joist 140, and joist sockets 60 may slidingly engage C channels 50 using structures and components other than T-bolts 70.

Apertures 56 (not shown) in bottom portion 51 of C channel 50 align with apertures 59 of deck retainer 58 (or toe board). Deck retainer bolts 57 secure C channel 50 to deck retainer 58 and joist 140 by engaging cage nuts 142 installed in joist 140.

T-bolts 70 may be inserted through apertures 64 in base 62 of joist socket 60 to partially engage nuts 78. Joist socket 60, with T-bolts 70 loosely and slidingly engaged in apertures 64, may be slide over the end of C channel 50 such that the head 72 of T-bolts 70 is within C channel 50. The head 72 of the T-bolts 70 is wider than the opening in the C channel 50 so that the T-bolt head 72 engages the inner surfaces of flanges 53. Upward movement of the joist socket 60 relative to the C channel 50 is thereby prevented. Once the joist socket 60 is in a desired position along C channel 50, nuts 78 are tightened on T-bolts 70 to secure joist sockets 60 in place using compression force.

Figure 15:
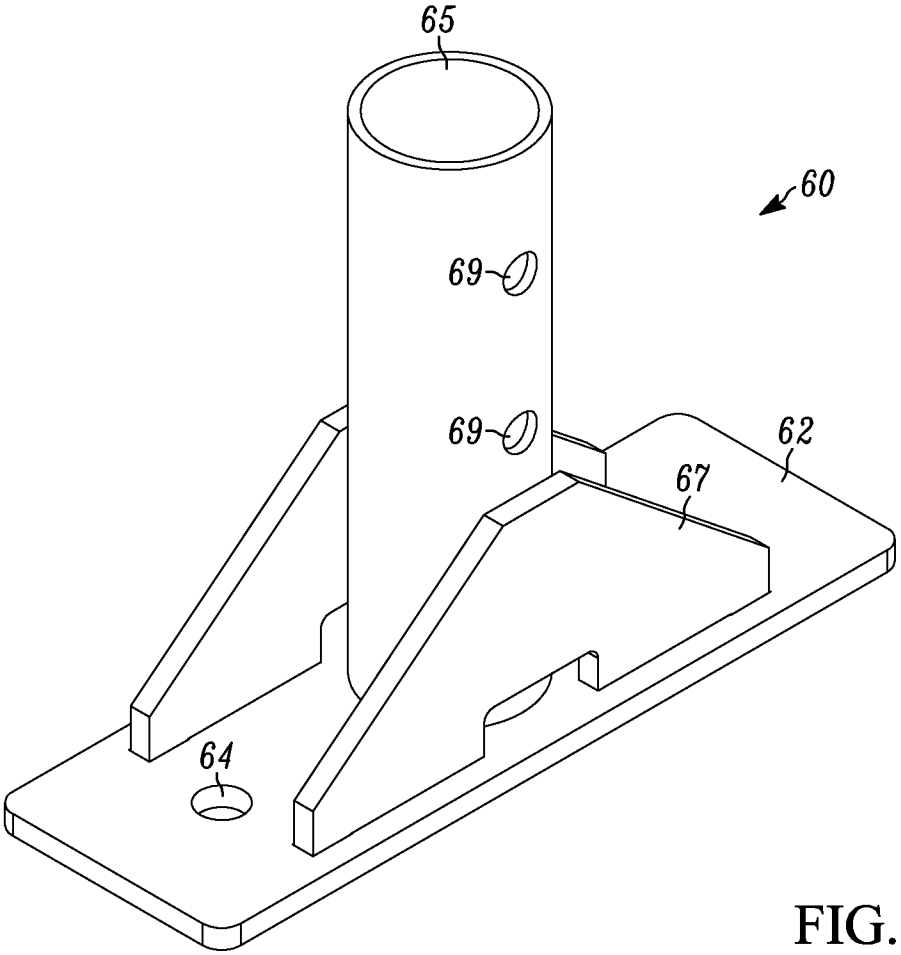
FIG. 15 is an isometric view of a joist socket.

FIG. 15 is an isometric view of a joist socket 60 showing tubular body 65 with apertures 69 for engaging structural elements of a supported work platform system. Base 62 includes apertures 64 for receiving T-bolts 70 and supporting braces 67 for structural integrity. In some exemplary embodiments, base 62 may include additional apertures 64 for T-bolts 70, and braces 67 may be of different sizes or configurations.

Figure 16:
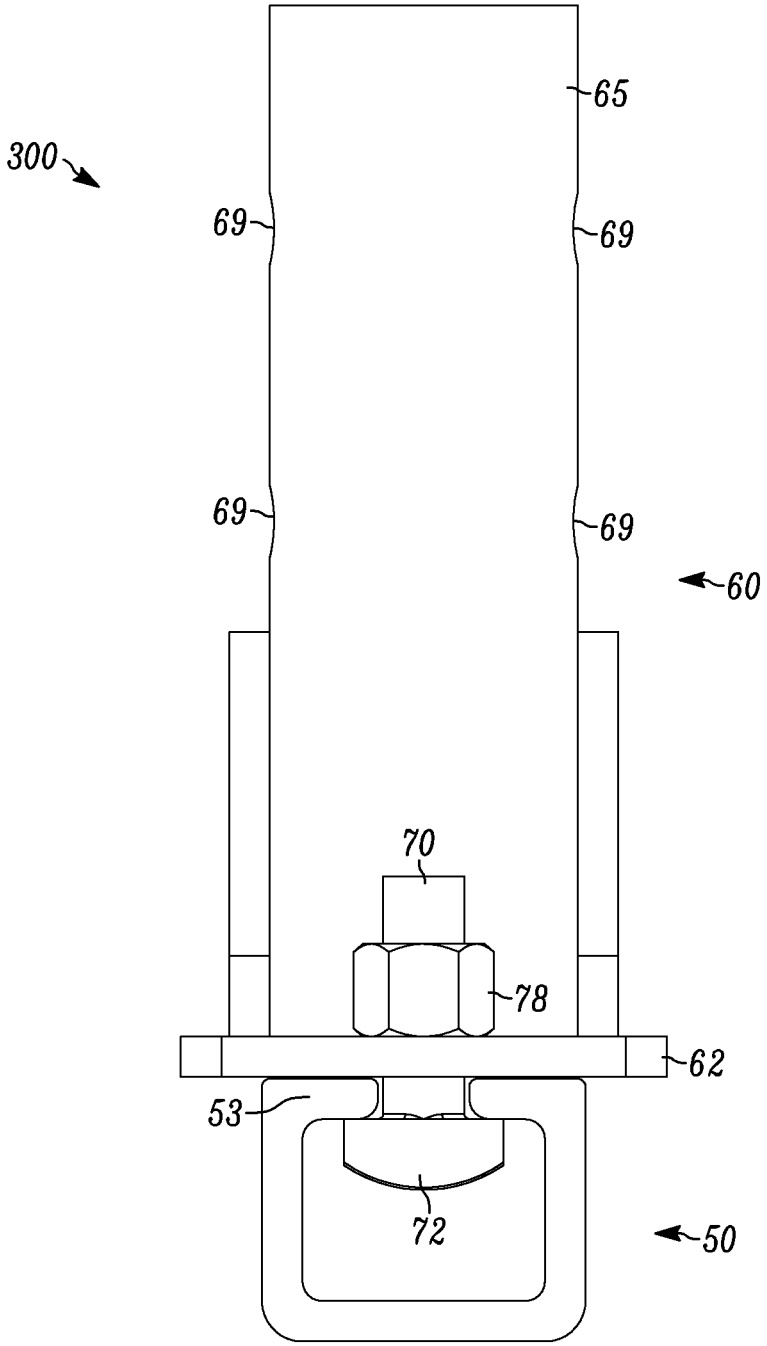
FIG. 16 is an end elevation view of an integration assembly.
Figure 17:
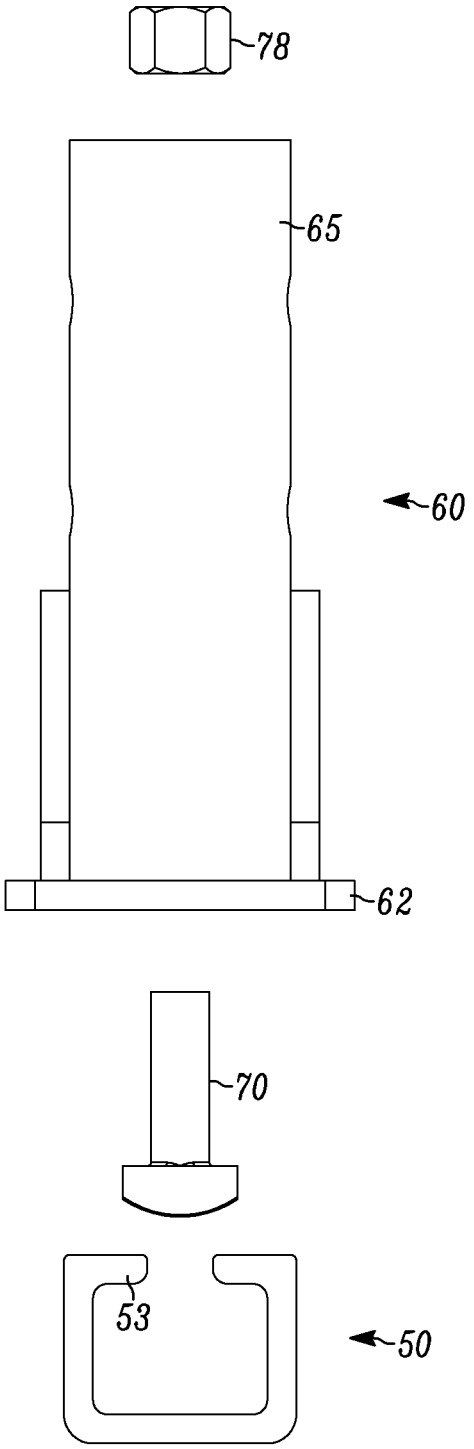
FIG. 17 is an exploded view of FIG. 16.

FIG. 16 is an end elevation view of an assembled integration assembly 300. Tubular body 65 is hollow, with apertures 69 open to hollow tubular body 65. T-bolt 70 is extended through base 62 and opening of channeled structure 50, which in the exemplary embodiment shown is a C channel. Bolt head 72 is wider than the opening of C channel 50 and therefore engages flanges 53 when tightened in place by nut 78. FIG. 17 is an exploded view of the integration assembly 300 of FIG. 16.

Figure 18:
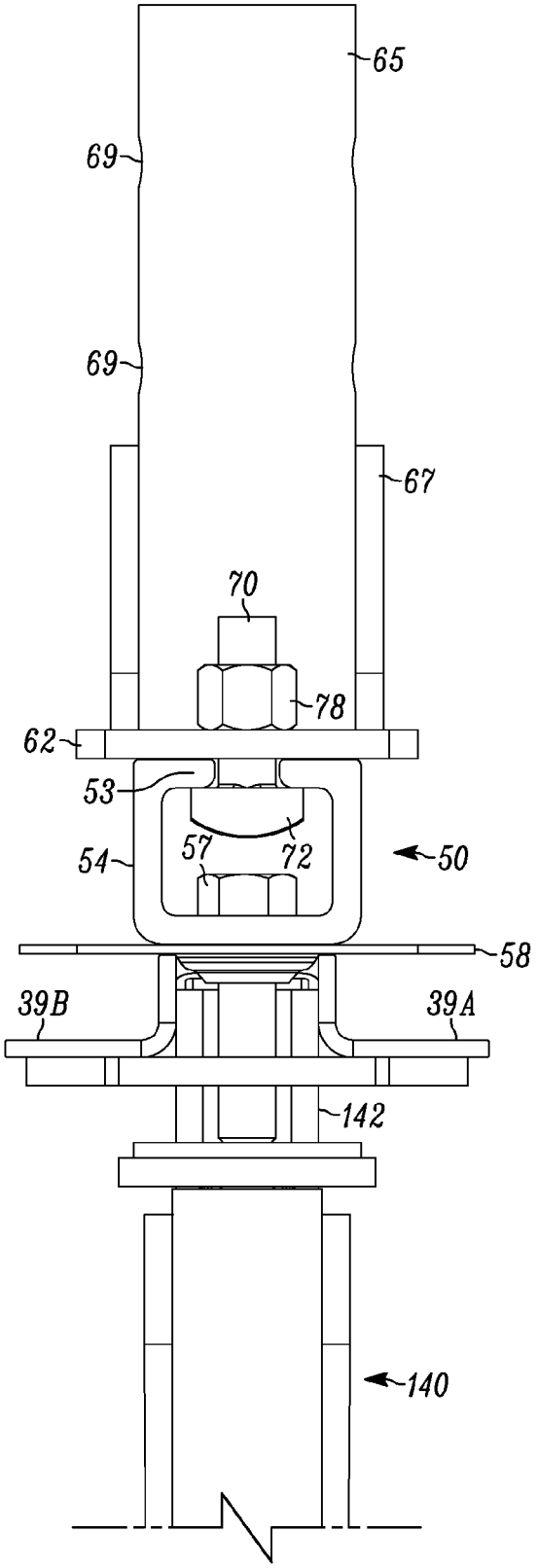
FIG. 18 is an end elevation view of an integration assembly secured to a joist.
Figure 19:
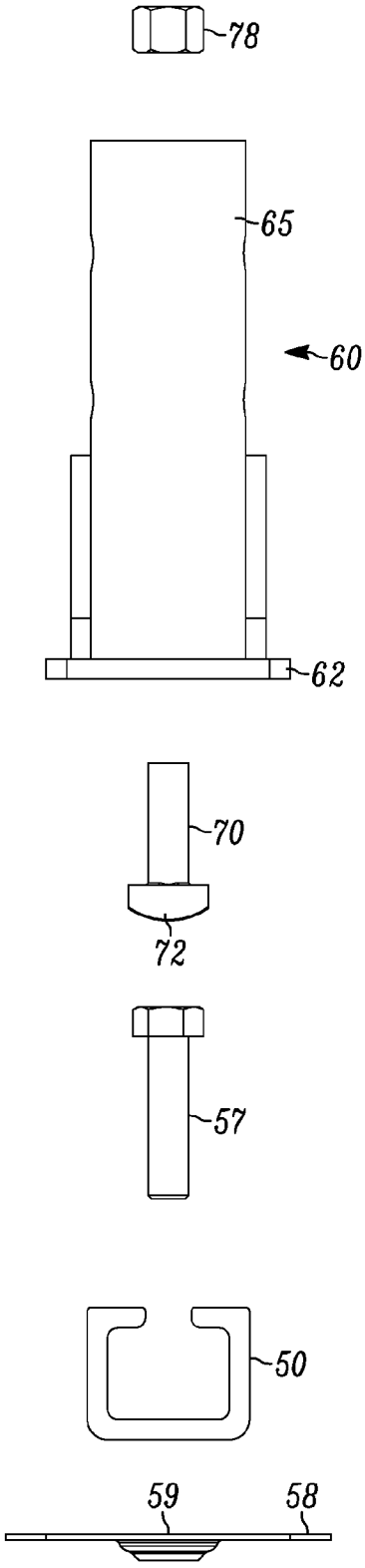
FIG. 19 is an exploded view of FIG. 18.

FIG. 18 is side view of an integration assembly 300 secured to a joist 140. Deck retainer bolt 57 extends through channeled structure 50, which in the exemplary embodiment shown is a C channel, and deck retainer 58 and into cage nut 142 in joist 140 to secure C channel 50 to joist 140. FIG. 19 is an exploded view of the integration assembly 300 with deck retainer 58 FIG. 18. FIG. 19 illustrates aperture 59 of deck retainer 58 as having a protuberance around the underside of the aperture 59. As shown more clearly in FIG. 18, the protuberance around aperture 59 fits between the two L-shaped pieces of angle iron 39A, 39B of elements 32, 33 to provide additional stability.

Figure 20:
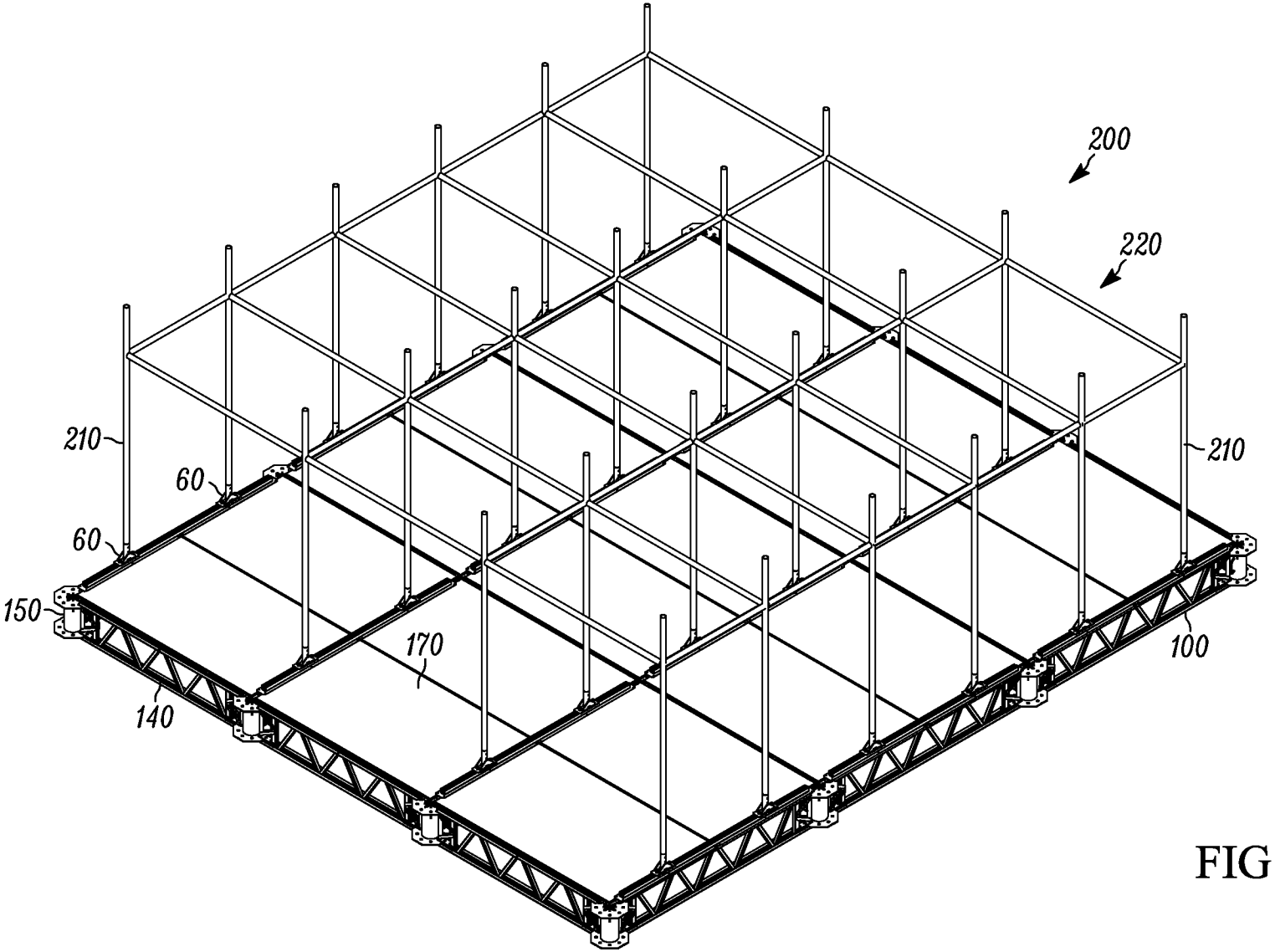
FIG. 20 is an exemplary base structure with an integrated second structure using a plurality of integration assemblies.

FIG. 20 illustrates an exemplary second structure 200 integrated with the base structure 100 shown in FIG. 11 using access structure integration assemblies 300. In the exemplary embodiment shown, framework 210 of second structure 200 comprises interconnected legs which are secured in joist sockets 60. Preferably, and as illustrated in FIG. 20, second structure 200 is a work platform system, such as a supported work platform system, comprising a plurality of individual units 220.

In the exemplary embodiment shown, base structure 100 comprises a plurality of units 120, and the framework 210 of the second structure includes a plurality of interconnected legs and is configured to define a plurality of individual units 220. In further exemplary embodiments, base structure 100 may be only a single unit 120 or two or more units 120. In further exemplary embodiments, second structure 200 may be configured to be a single unit 220 or have framework 210 defining a single unit 220. In further exemplary embodiments, framework 210 of second structure 200 may secure platforms.

With legs of framework 210 secured in joist sockets 60, movement of the second structure 200 is prevented along the x, y and z axes, as well as rotationally about each axis, relative to joist sockets 60. When joist sockets 60 secured on C channels 50 (i.e., tightened on C channels as to be immovable), movement is prevented along the x, y and z axes, as well as rotationally about each axis, relative to base structure 100. Access structure integration assemblies 300 therefore effectively integrate base structure 100 and second structure 200. The term "integrated" as used herein and in reference to a suspended work platform or platform system supporting a supported work platform or platform system means that all six forms of movement (i.e., linear movement along the x, y and z axes and rotational movement about the x, y and z axes) of the supported work platform or platform system is prevented.

However, because joist sockets 60 are movable along C channels 50 when not secured in place, second structure 200 may be built at a convenient location on base structure 100 and slid into a final position after assembly. Similarly, a second structure 200 may be built and slid into different positions on base structure 100 to access various structures at different spots along base structure 100 as needed.

Because access structure integration assemblies 300 transfer the pressures exerted by the framework 210 of second structure 200 to panel points 144, the size of second structure 200 is limited by the amount of weight joists 140 of suspended work platform system 100 can bear. For example, when base structure 100 is a suspended work platform system and second structure 200 is a supported work platform system, the supported work platform system may include a single level or multiple levels, provided joists 140 continue to support the weight and pressures exerted by the supported work platform system.

Figure 21:
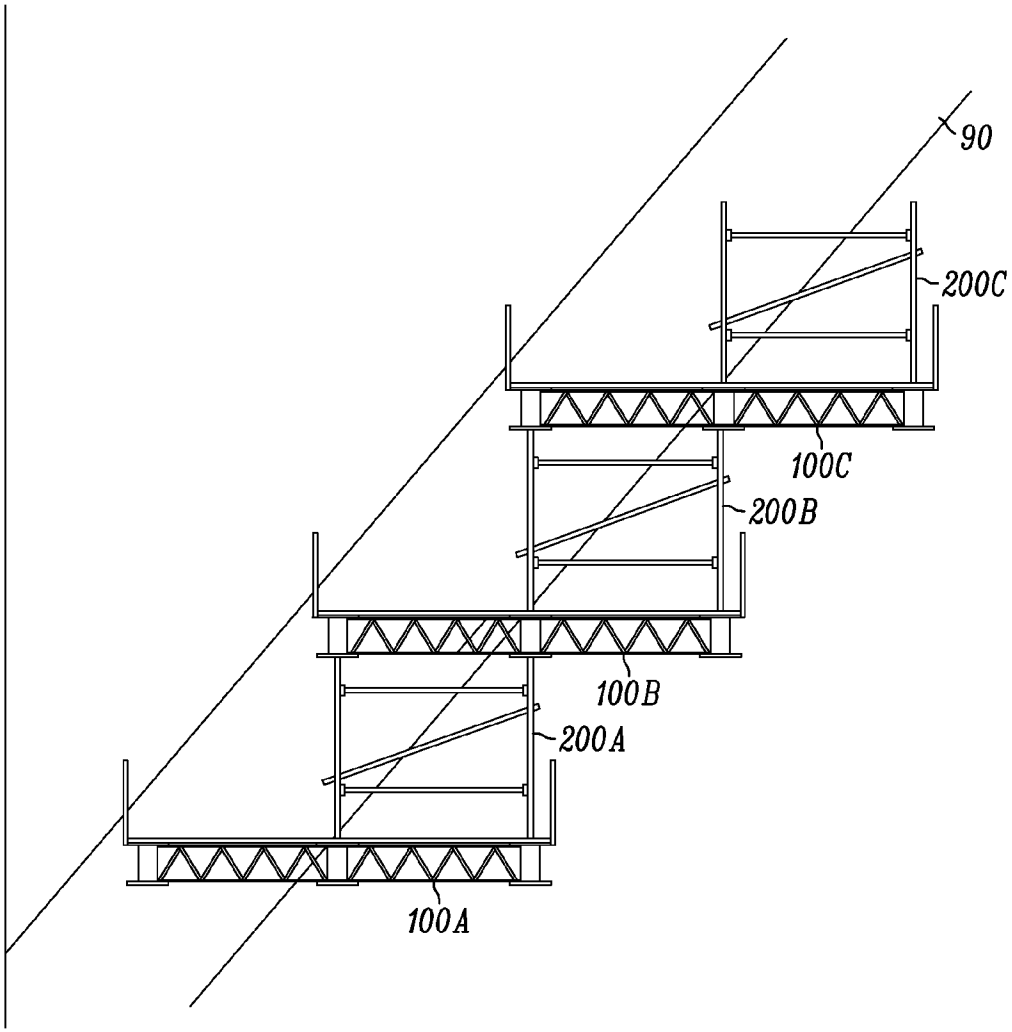
FIGS. 21-24 illustrate exemplary integrated systems.

FIG. 21 illustrates exemplary base structures 100 which are suspended work platform systems, with integrated second structures 200 which are supported work platform systems. In the embodiment shown, base structures 100 are suspended from structure 90, which is a diagonal beam. As illustrated, second structure 200 is integrated with base structure 100 using integration system 300 to provide access not only the undersides of structure 90, but also the side portions of structure 90 between suspended work platforms.

FIG. 21 also shows that base structures 100 may be integrated with and depend on second structure 200. For example, as illustrated in FIG. 21, base structure 100 may be an articulatable suspended work platform system, with suspended work platform system 100*b* built off of supported work platform system 200*a* and suspended work platform system 100*c* is built off of supported work platform system 200*b* as described in relation to FIGS. 6-10. Therefore, to continue accessing structure 90 above supported work platform 200*c*, workers can assemble additional suspended work platforms, such as described in FIGS. 6-10, from supported work platform 200*c* and then assemble additional supported work platform systems integrated with the newly suspended platform system as described herein.

Figure 22:
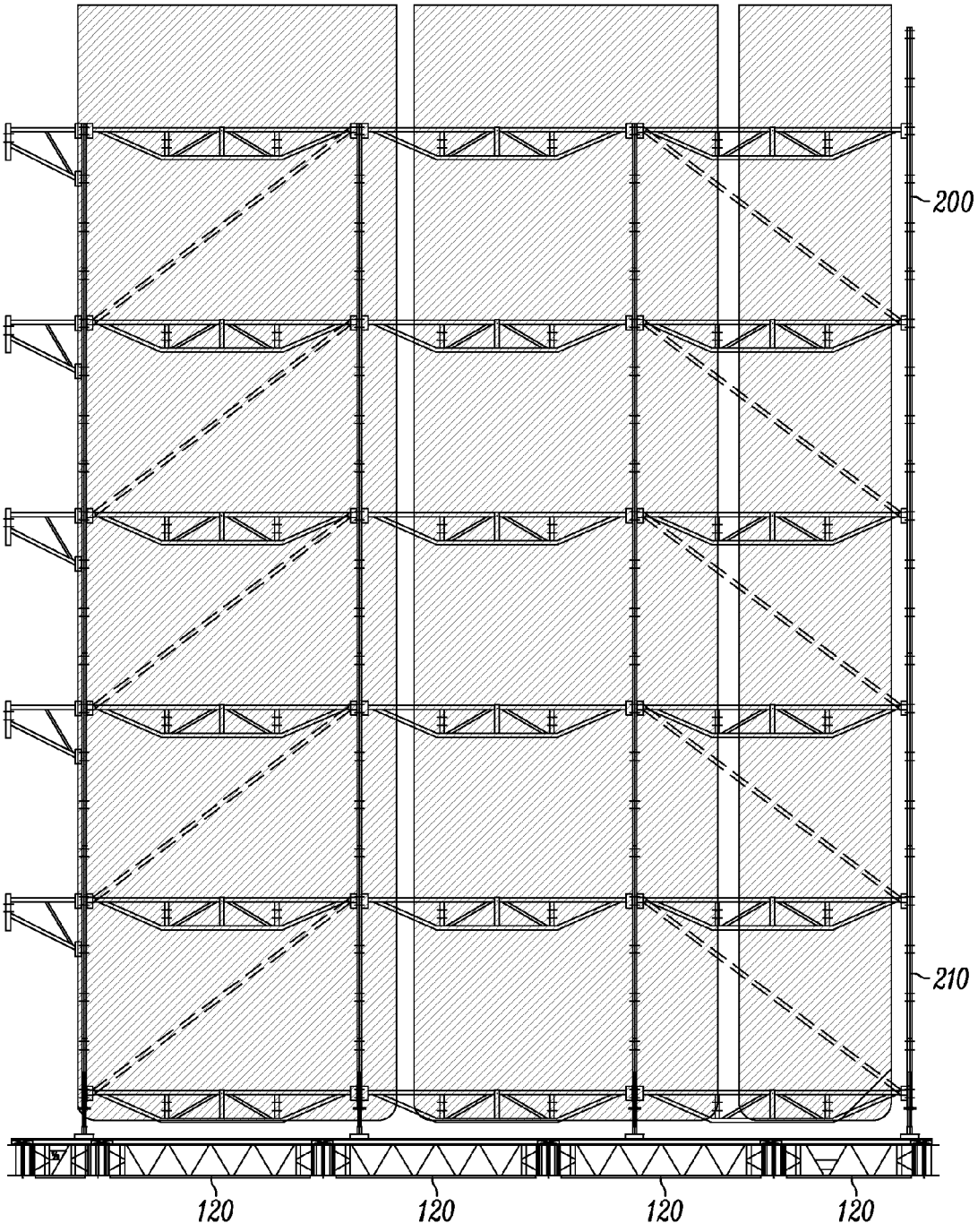

FIG. 22 illustrates a further exemplary embodiment of a base structure 100 integrated with a second structure 200 using access structure integration assemblies 300. In the exemplary embodiment shown, base structure 100 is a suspended work platform assembly and second structure 200 is a supported work platform assembly. Base structure 100 is suspended from an overhead structure (not shown) and used to access substructures 91. For example, As illustrated in FIG. 22, base structure 100 is suspended from an overhead structure with second structure 200, which is a supported work platform system, built upward from base structure 100. In the exemplary embodiment shown in FIG. 22, six levels of supported work platform are secured above base structure 100. As illustrated in FIG. 22, the levels of the supported work platform system are parallel with, but not coplanar to, each other. As described above, the number of levels of second structure 200 integrated with a base structure 100 will vary depending on the job to be done and the maximum about of weight joists 140 can support.

Figure 23:
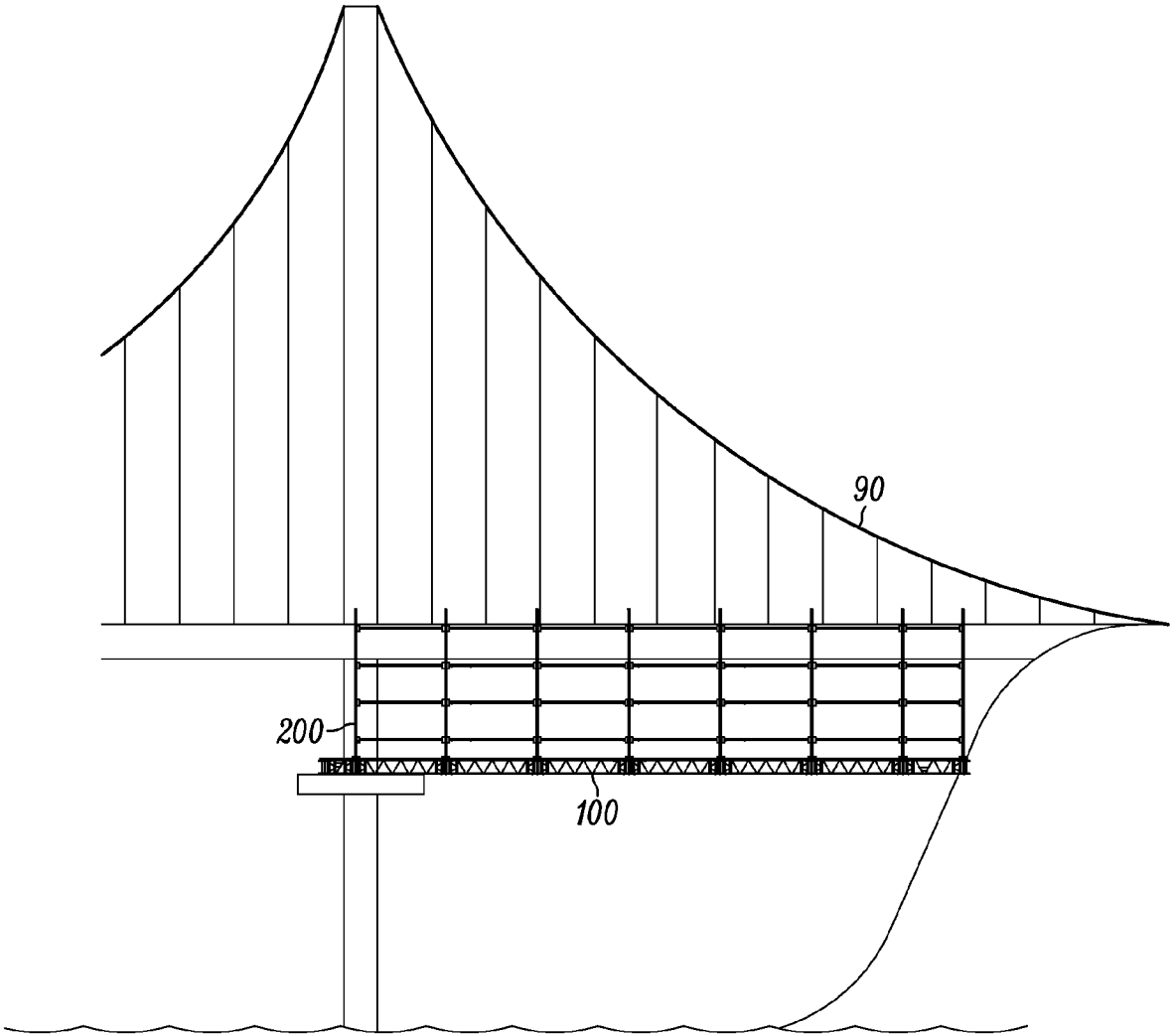

FIG. 23 illustrates an exemplary embodiment of a base structure 100 with access structure integration assemblies 300 integrating a second structure 200, wherein the base structure 100 is a suspended work platform system and the second structure 200 is a supported work structure system. The supported work platform system is built upward from the suspended work platform system secured under structure 90, which in the embodiment shown is a structure spanning two points, such as, for example, a bridge or portion of an offshore rig. As illustrated, base structure 100 is suspended under structure 90 and also extends outside the footprint of the overhead structure 90. Second structure 200 is built upward from the portion of base structure 100 which is not directly under structure 90 in order to access the sides of structure 90.

Figure 24:
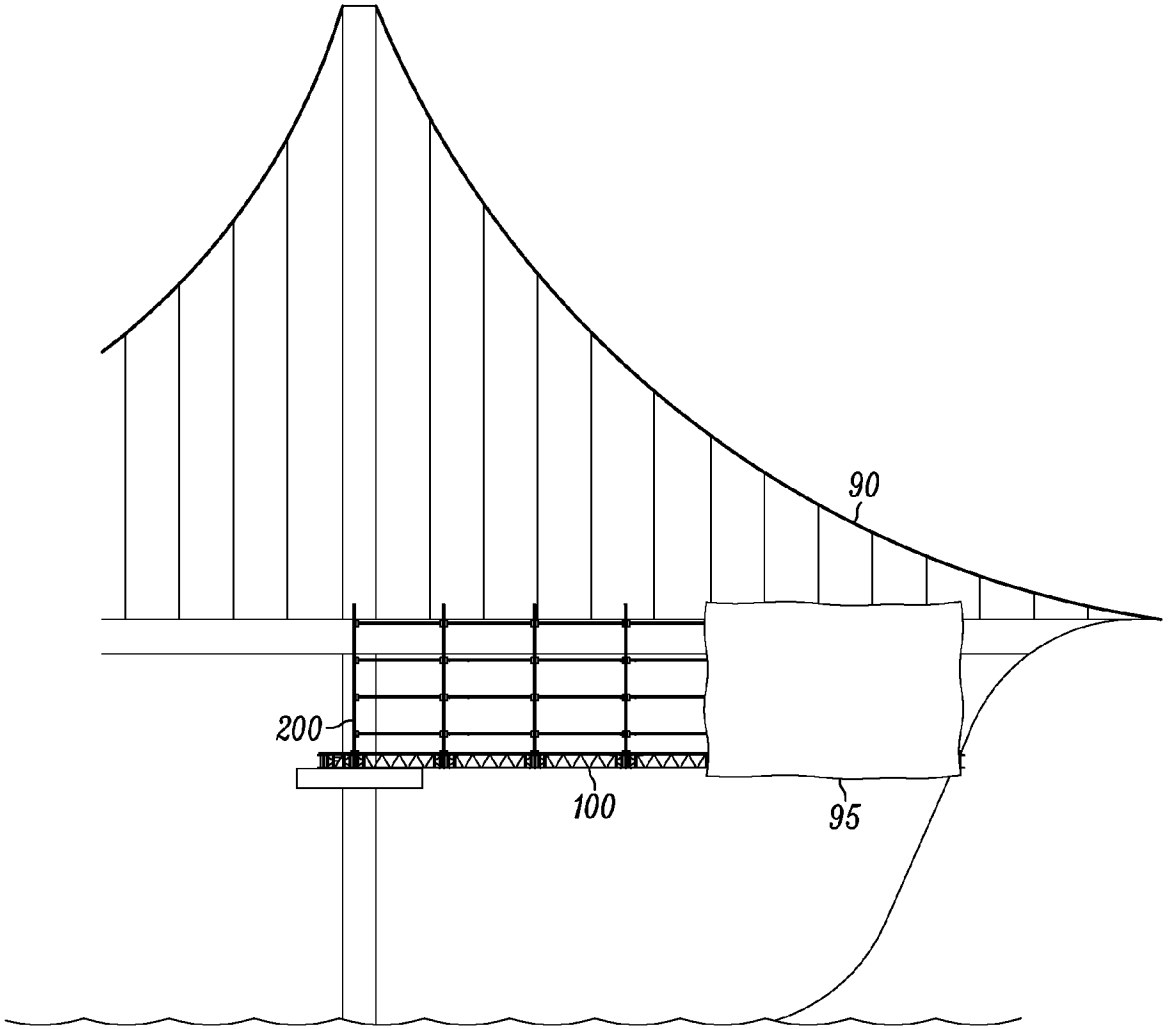

In further embodiments, a second structure may be integrated with a base structure to provide support for objects, such as tarps or barriers, as shown in FIG. 24. In FIG. 24, second structure 200 is integrated with base structure 100 using integration assemblies 300, and second structure is used to secure barrier 95 which is a tarp. When, for example, painting structure 90, barrier 95 prevents debris (e.g., dirt, dust, water, pollen) from entering the work area and damaging or disrupting the painting or drying processes. Barrier 95 also prevents contaminants (e.g., fumes, vapor, particles) from escaping the work area and entering the environment. Second structure 200 is therefore used to create factory-like conditions in the field.

Although the figures and description provided herein illustrate a base structure 100 which is a suspended or articulated suspended work platform system integrated with a second structure which is a supported work platform system, it is understood that integration assembly 300 may be used to integrate a variety of base structures and second structures.

Nonlimiting examples of embodiments of the present disclosure are provided below.

In an embodiment E1, an access structure integration assembly comprising at least one channeled structure; and at least one joist socket, wherein the joist socket is slidingly engaged with the channeled structure. E2. The assembly of E1, wherein the channeled structure comprises: a solid, flattened bottom portion; two flattened side wall portions extending upward from the bottom portion at approximately right angles, each side wall portion terminating in a flange extending at a right angle from the side wall portions such that the flanges extend toward each other; and a linear gap extending the length of the channeled structure and having a width. E3. The assembly of E2, wherein the joist socket is slidingly engaged with the channeled structure using at least one T-bolt which is slidingly engaged with the linear gap of the channeled structure. E4. The assembly of E3, wherein the T-bolt comprises a head having a width greater than that of the linear gap. E5. The assembly of E1, wherein the joist socket comprises: a hollow tubular body; and a base. E6. The assembly of E1, wherein the channeled structure is configured to secure to a base structure and the joist socket is configured to secure to a second structure. E7. The assembly of E6, wherein the base structure is a suspended work platform system. E8. The assembly of E7, wherein the suspended work platform is articulatable. E9. The assembly of E6, wherein the second structure is a supported work platform system. E10. The assembly of E1, further comprising a deck retainer.

In an embodiment, E11, an access structure integration assembly comprising: at least one substantially squared tubular channeled structure, the channeled structure comprising a solid, flattened bottom portion containing a plurality of apertures corresponding to the apertures of the deck retainer, two flattened side wall portions extending upward from the bottom portion at approximately right angles, each side wall portion terminating in a flange extending at a right angle from the side wall portions such that the flanges extend toward each other, and a linear gap extending the length of the channeled structure and having a width; at least one joist socket comprising a hollow tubular body, and a base having a plurality of apertures; a plurality of T-bolts extending through the apertures of the joist socket and into the linear gap of the channeled structure and having a head portion with a width greater than that of the linear gap, wherein the T-bolts are slidingly engaged with the channeled structure and each of the T-bolts is secured with a nut; and optionally, at least one substantially linear deck retainer comprising a plurality of apertures corresponding to the apertures of the channeled structure, wherein the deck retainer is parallel to the channeled structure and secured to the channeled structure by a plurality of bolts, each bolt extending through a set of corresponding apertures of the channeled structure and deck retainer.

In an embodiment, E12. a base structure comprising: at least one unit; at least two access structure integration assemblies secured to the at least one unit, each integration assembly comprising at least one channeled structure, and at least one joist socket slidingly engaged with the channeled structure, wherein each channeled structure is secured to the unit. E13. The base structure of E12, wherein the channeled structure is a substantially squared tubular C channel and comprises: a solid, flattened bottom portion; two flattened side wall portions extending upward from the bottom portion at approximately right angles, each side wall portion terminating in a flange extending at a right angle from the side wall portions such that the flanges extend toward each other; and a linear gap extending the length of the C channel and having a width. E14 The base structure of E13, wherein the joist sockets are slidingly engaged with the C channels using at least one T-bolt which is slidingly engaged with the linear gap of the C channel. E15. The base structure of E12, further comprising a deck retainer. E16. The base structure of E15, wherein the deck retainer is secured between the unit and a C channel such that the deck retainer is parallel with the channeled structure. E17. The base structure of E12, wherein the at least one unit comprises four joists interconnected with four hubs. E18. The base structure of E12, wherein the joist sockets are configured to secure to a second structure. E19. The base structure of E18, wherein the second structure is a supported work platform system. E20. The base structure of E12, wherein the unit comprises at least two joists and each integration assembly is secured to one of the joists. E21. The base structure of E20, wherein the joists contain a plurality of cage nuts and the C channels comprise a plurality of apertures corresponding to the cage nuts. E22. The base structure of E16, wherein the integration assemblies are secured to the joists by a plurality of bolts, each bolt extending through an aperture of the channeled structures and engaging a corresponding cage nut. E23. The base structure of E12, comprising a plurality of units, each unit defined by four joists interconnected with four hubs, wherein the joists and hubs are interconnected such that the joists are copolanar with respect to one another. E24. The base structure of E23, wherein each joist comprising an upper element and a bottom element. E25. The base structure of E24, comprising a plurality of integration assemblies, each integration assembly secured to the upper element of a joist and parallel to the joist. E26. The base structure of E25, wherein each joist further comprises a plurality of cage nuts and each C channel includes a plurality of apertures corresponding to the cage nuts. E27. The base structure of E26, wherein the integration assemblies are secured to the joists by a plurality of bolts, each bolt extending through an aperture in the channeled structure and engaging a cage nut. E28. The base structure of E17 further comprising a plurality of suspension connectors secured to the hubs.

In an embodiment, E29, a suspended work platform system comprising: a plurality of joists, each having an upper element and a bottom element; a plurality of hubs; wherein the plurality of joists comprises at least four joists and wherein the plurality of hubs comprises at least four hubs; wherein the joists and hubs are interconnected such that the joists are coplanar with respect to each other; a plurality of access structure integration assemblies, each integration assembly comprising a substantially linear deck retainer comprising a plurality of apertures; a substantially squared tubular channeled structure parallel with the deck retainer comprising a solid, flattened bottom portion containing a plurality of apertures corresponding to the apertures of the deck retainer, two flattened side wall portions extending upward from the bottom portion at approximately right angles, each side wall portion terminating in a flange extending at a right angle from the side wall portions such that the flanges extend toward each other, and a linear gap having extending the length of the channeled structure and having a width; a plurality of deck retainer bolts extending through the corresponding apertures of the deck retainer and channeled structure; a plurality of joist sockets comprising a hollow tubular body 7 and a base having a plurality of apertures, and a plurality of T-bolts extending through the apertures of the joist socket and into the linear gap of the channeled structure and having a head portion with a width greater than that of the linear gap, wherein the T-bolts are slidingly engaged with the channeled structure and each of the T-bolts is secured with a nut; wherein each channeled structure secures at least two joist sockets, wherein each integration assembly is secured to the upper element of one of the joists, and wherein the number of joists is greater than the number of integration assemblies. E30. The suspended work platform system of E29, wherein the joists comprise a plurality of cage nuts which engage the deck retainer bolts to secure deck retainer and channeled structure to joists. E31. The suspended work platform system of E29, further comprising at least two suspension connectors, each secured to one of the hubs. E32. The suspended work platform system of E29, wherein the joist sockets are configured to secure a second structure. E33. The suspended work platform system of E32, wherein the second structure is a supported work platform system. E34. The suspended work platform system of E29 which is articulatable. E35. The suspended work platform system of E29, wherein at least one of the hubs comprises a first surface with a set of openings; a second surface substantially parallel to the first surface, the second surface having a second set of openings; and a structural element connected between the first surface and second surface, wherein at least one of the first set and the second set of openings is co-axial with respect to one of the openings in the second set of openings.

In an embodiment, E36, an integrated system comprising: a base structure; a second structure; at least two integration assemblies, each assembly comprising a channeled structure, and at least one joist socket slidingly engaged with the C channel; wherein the base structure is secured to the channeled structure, and wherein the second structure is secured to the joist socket. E37. The integrated system of E36, wherein the base structure is a work platform system. E38. The integrated system of E37, wherein the base structure is a suspended work platform system. E39. The integrated system of E38, wherein the suspended work platform system is articulatable. E40. The integrated system of E36, wherein the base structure comprises at least one unit comprising at least four joists, each having an upper element and a bottom element, wherein at least two of the joists include at least four cage nuts; and at least four hubs, wherein the joists and hubs are interconnected such that the joists are coplanar with respect to each other. E41. The integrated system of E36, wherein the integration assemblies each further include a substantially linear deck retainer. E42. The integrated system of E40, wherein each integration assembly is secured to a joist such that the integration assembly is parallel with the joist. E43. The integrated system of E42, wherein each joist further includes at least two cage nuts. E44. The integrated system of E43, wherein each integration assembly is secured to the joist using at least two bolts which each engage one cage nut. E45. The integrated system of E36, wherein each channeled structure is a C channel comprising a solid, flattened bottom portion, two flattened side wall portions extending upward from the bottom portion at approximately right angles, each side wall portion terminating in a flange extending at a right angle from the side wall portions such that the flanges extend toward each other, and a linear gap extending the length of the C channel and having a width. E46. The integrated system of E45, wherein each joist socket is slidingly engaged with the C channel by a T-bolt slidingly engaged with the linear gap of the C channel. E47. The integrated system of E36, wherein each joist socket comprises a hollow tubular body and a base. E48. The integrated system of E36, wherein each integration assembly comprises two joist sockets. E49. The integrated system of E36, wherein the second structure is at least one unit of a work platform system. E50. The integrated system of E49, wherein the second structure is a supported work platform system. E51. The integrated system of E50, wherein the supported work platform system comprises at least two levels. E52. The integrated system of E36, further comprising a barrier secured to the second structure. E53. The integrated system of E36, wherein the second structure is shoring. E54. The integrated system of E36, further comprising a third structure, the third structure comprising at least four hubs; and at least four joists, each of the four joists configured to be interconnected with at least two of the four hubs; wherein the joists and hubs are configured to be interconnected so that (i) one of the joists—and two of the hubs—configured to remain stationary; (ii) two of the joists are rotatable; and (iii) two of the hubs—and one of the joists—are translatable; wherein the two stationary hubs are each connected to the second structure; wherein, when interconnected, the two rotatable joists, the two translatable hubs, and the one translatable joist can articulate from an initial position to a final position with respect to the stationary joist and the stationary hubs; wherein the at least four joists are substantially coplanar with respect to each other in the initial and final positions; wherein at least one of the joists is configured to be connected with at least one of the hubs using a pin to provide free rotation of the at last one joist with respect to the at last one hub about the pin; and wherein the free rotation is restricted by at least one of (i) an additional pin that is to be located proximate a perimeter of the at least one hub; and (ii) at least a portion of a platform when the platform is positioned with respect to the hubs and joists in the final position.

In an embodiment E55, an integrated work platform system for suspending from an overhead structure, the system comprising: a first structure comprising at least two suspension connectors with a first end and a second end, wherein the second end is configured to secure to an overhead structure; a plurality of joists, each having an upper element and a bottom element; and a plurality of hubs, at least two of the hubs having a first surface with an opening configured to engage the first end of the suspension connectors, wherein the plurality of joists comprises at least four joists and wherein the plurality of hubs comprises at least four hubs; wherein the joists and hubs are interconnected such that the joists are coplanar with respect to each other; a plurality of integration assemblies, each secured to a joist and comprising a substantially linear deck retainer comprising a plurality of apertures; a substantially squared tubular C channel parallel with the deck retainer, each C-channel comprising a solid, flattened bottom portion containing a plurality of apertures corresponding to the apertures of the deck retainer, two flattened side wall portions extending upward from the bottom portion at approximately right angles, each side wall portion terminating in a flange extending at a right angle from the side wall portions such that the flanges extend toward each other, and a linear gap extending the length of the C channel and having a width; a plurality of deck retainer bolts extending through the corresponding apertures of the deck retainer and C channel; a plurality of joist sockets comprising a hollow tubular body, and a base having a plurality of apertures, and a plurality of T-bolts extending through the apertures of the joist socket and into the linear gap of the C channel and having a head portion with a width greater than that of the linear gap, wherein the T-bolts are slidingly engaged with the C channels and each of the T-bolts is secured with a nut; wherein each C channel secures at least two joist sockets; and a second structure having framework secured to the joist sockets. E56. The integrated work platform system of E55, wherein the second structure includes a plurality of coplanar platforms. E57. The integrated work platform system of E56, further comprising at least one additional platform parallel to, but not copolanar with, the platforms. E58. The integrated work platform system of E56, wherein the second structure comprises at least three parallel, non-coplanar platforms. E59. A method of integrated a second structure with respect to a base structure, the method comprising: providing a base structure; providing a second structure; providing at least two integration assemblies, each integration assembly comprising a C channel and a joist socket slidingly engaged with the C channel; and securing the C channels of the integration assemblies to the base structure and securing the joist sockets of the integration assemblies to the second structure. E60. The method of E59, wherein the base structure is a suspended work platform system. E61. The method of E60, wherein the base structure is articulatable. E62 The method of E59, wherein the second structure is a work platform system.

In an embodiment, E63, a method of installing a supported work platform system with respect to a suspended work platform system, the method comprising: providing a suspended work platform system that is suspended from a structure, the suspended work platform system comprising a plurality of interconnected hubs and joists such the joists are coplanar with respect to each other, aligning a plurality of deck retainers parallel to a plurality of joists such that the number of deck retainers is less than the number of joists and the deck retainers are each parallel with respect to each other; aligning a plurality of C-channels collinear with the deck retainers, wherein the C-channels comprise a solid, flattened bottom portion containing a plurality of apertures corresponding to the apertures of the deck retainer, two flattened side wall portions extending upward from the bottom portion at approximately right angles, each side wall portion terminating in a flange extending at a right angle from the side wall portions such that the flanges extend toward each other, and a linear gap extending the length of the C channel, wherein each flange has an inner surface and an outer surface; securing the deck retainers and C-channels to the joists using a plurality of bolts; providing a plurality of joist sockets, the joist sockets comprising a tubular body, a base with at least two apertures, one T-bolt projecting through each of the apertures such that the T-bolt is oppose that tubular body, and a nut partially engaged with each T-bolt; sliding each joist socket along the outer surface of one of the flanges such that the T-bolts pass through the linear gap; tightening the nuts so that the head of the T-bolts engage the inner surfaces of the flanges; and securing a first end of a supported work platform system frame member in each of the plurality of joist sockets. E64. The method of E63, further comprising providing a work platform assembly on a second end of the supported work platform system frame members. E65. The method of E64, further comprising: providing an articulatable work platform assembly comprising a plurality of hubs and a plurality of joists connected to the plurality of hubs; and articulating the articulatable work platform assembly from an initial position to a final position, the articulating including at least one of rotating and translating one or more of the plurality of joists with respect to one or more of the plurality of hubs; wherein the plurality of joists are substantially coplanar with respect to each other in the initial and final positions.

The foregoing description of the present invention has been presented for purposes of illustration and description. It is not intended to be exhaustive or to limit the invention to the precise form disclosed or to the materials in which the form may be embodied, and many modifications and variations are possible in light of the above teaching.

It is specifically intended that the present invention not be limited to the embodiments and illustrations contained herein, but include modified forms of those embodiments including portions of the embodiments and combinations of elements of different embodiments as come within the scope of the following claims.

What is claimed is:

1. An access structure integration assembly comprising:

at least one channeled structure including a linear gap, wherein the channeled structure has a bottom portion having a plurality of apertures and two flattened side walls extending from the bottom portion in the same direction at approximately right angles so as to be parallel to one another, wherein the side walls terminate in a flange, the flanges extending towards one another at approximately right angles relative to the side walls, thereby creating a C-shape and the linear gap;

a deck retainer comprising a plurality of apertures, each of said plurality of apertures of the deck retainer corresponding to one of the plurality of apertures of the channeled structure; and at least one socket which comprises a hollow tubular body, a base and at least one T-bolt, wherein the base of the socket is slidingly engaged with the linear gap of the channeled structure using the at least one T-bolt, and wherein the bottom portion of the at least one channeled structure is configured to secure to an elongate structural member by a plurality of bolts, each of said bolts configured to engage a corresponding pair of apertures of the pluralities of apertures with the deck retainer configured to be positioned between the at least one channeled structure and the elongate structural member.

2. The assembly of claim 1, wherein the channeled structure is configured to secure to the elongate structural member of a base structure, the elongate structural member comprising a plurality of intersecting diagonal support members and joist socket is configured to secure to a second structure.

3. The assembly of claim 2, wherein the base structure is a suspended work platform system.

4. The assembly of claim 3, wherein the suspended work platform is articulatable.

5. The assembly of claim 2, wherein the second structure is a supported work platform system.

6. A base structure comprising:

at least one unit comprising at least two elongate structural members, each elongate structural member comprising an upper element, a lower element, a plurality of cage nuts positioned along the upper element, and a plurality of diagonal support members interspersed between the upper and lower elements, wherein at least two pairs of the diagonal support members intersect to form at least two panel points along the upper element;

at least two access structure integration assemblies, each assembly secured to and parallel with a respective one of the elongate structural members of the at least one unit, each integration assembly comprising at least one channeled structure including a linear gap, wherein the channeled structure comprises a bottom portion having a plurality of apertures, each of said apertures corresponding to a respective one of the plurality of cage nuts, and at least one socket comprising a hollow tubular body, a base and at least one T-bolt, wherein the base of the socket is slidingly engaged with the linear gap of the channeled structure using the at least one T-bolt, wherein each channeled structure of the integration assemblies is secured to and parallel with one of the upper elements of one of the elongate structural members by a plurality of bolts, wherein each of the plurality of bolts engages a respective aperture with corresponding cage nut.

7. The base structure of claim 6, wherein the channeled structure is a substantially squared tubular C channel and comprises:

the bottom portion which is flattened;

two flattened side wall portions extending upward from the bottom portion at approximately right angles, each side wall portion terminating in a flange extending at a right angle from the side wall portions such that the flanges extend toward each other; and the linear gap having a width.

8. The base structure of claim 7, wherein the sockets are slidingly engaged with the C channels using at least one T-bolt which is slidingly engaged with the linear gap of the C channel.

9. The base structure of claim 6, wherein the sockets are configured to secure to a supported work platform system.

10. The base structure of claim 6, comprising a plurality of units, each unit defined by four elongate structural members interconnected with four hubs, wherein the elongate structural members and hubs are interconnected such that the elongate structural members are copolanar with respect to one another.

11. The base structure of claim 10, wherein each elongate structural member comprises an upper element and a bottom element.

12. The base structure of claim 11, comprising a plurality of integration assemblies, each integration assembly secured to the upper element of a elongate structural member and parallel to the elongate structural member.

* * * * *